US010588360B2

(12) United States Patent
Chase, Jr. et al.

(10) Patent No.: US 10,588,360 B2
(45) Date of Patent: Mar. 17, 2020

(54) IMPACT REDUCTION APPAREL AND IMPACT ABSORBING LINER FOR APPAREL

(71) Applicants: John Dana Chase, Jr., Encinitas, CA (US); George Octavio Flint, Encinitas, CA (US); Jason William Hancock, San Diego, CA (US)

(72) Inventors: John Dana Chase, Jr., Encinitas, CA (US); George Octavio Flint, Encinitas, CA (US); Jason William Hancock, San Diego, CA (US)

( * ) Notice: Subject to any disclaimer, the term of this patent is extended or adjusted under 35 U.S.C. 154(b) by 367 days.

(21) Appl. No.: 14/685,556

(22) Filed: Apr. 13, 2015

(65) Prior Publication Data

US 2016/0235133 A1 Aug. 18, 2016

Related U.S. Application Data

(60) Provisional application No. 62/120,266, filed on Feb. 24, 2015, provisional application No. 62/119,051, filed on Feb. 20, 2015, provisional application No. 61/978,650, filed on Apr. 11, 2014.

(51) Int. Cl.

| | |
|---|---|
| ***A41D 13/015*** | (2006.01) |
| ***A42B 1/08*** | (2006.01) |
| ***A42B 3/12*** | (2006.01) |
| *A63B 71/12* | (2006.01) |

(52) U.S. Cl.

CPC ..... *A41D 13/0158* (2013.01); *A42B 1/08* (2013.01); *A42B 3/12* (2013.01); *A41D 13/015* (2013.01); *A63B 2071/1258* (2013.01)

(58) Field of Classification Search

CPC .... A41D 13/015; A41D 13/0158; A42B 1/08; A42B 3/12; A63B 2071/1258

USPC ..... 2/413

See application file for complete search history.

(56) References Cited

U.S. PATENT DOCUMENTS

| | | | | | |
|---|---|---|---|---|---|
| 2,946,063 | A | * | 7/1960 | Boyer | A42B 1/10 2/418 |
| 2,983,923 | A | * | 5/1961 | Aileo | A42B 3/14 2/418 |
| 3,026,523 | A | * | 3/1962 | Bowers, Sr. | A42B 3/14 2/416 |
| 3,127,615 | A | * | 4/1964 | Aileo | A42B 3/14 2/416 |
| 3,175,225 | A | * | 3/1965 | Lindblom | A42B 3/14 2/416 |

(Continued)

*Primary Examiner* — Anne M Kozak

(74) *Attorney, Agent, or Firm* — Mintz Levin Cohn Ferris Glovsky and Popeo, P.C.

(57) ABSTRACT

An impact absorbing liner apparatus and impact reduction apparel are disclosed. An impact absorbing liner has a size and a configuration, such as multiple extending impact absorbing members, which can be formed and shaped around a part of a wearer's body. The impact absorbing liner is at least partially obscured from external view by apparel worn over the part of the wearer's body. The apparatus further includes a rigid frame connected with the impact absorbing liner and having at least a distal end and a proximal end. The distal end and proximal end each have a connection mechanism to connect together to provide the size and the configuration for the impact absorbing liner, and to conform to the impact reduction apparel.

7 Claims, 29 Drawing Sheets

(56) References Cited

U.S. PATENT DOCUMENTS 3,268,911 A * 8/1966 Cox ..... A42B 3/14 2/181.4
3,315,273 A * 4/1967 Bullard ..... A42B 1/08 2/418
3,422,459 A * 1/1969 Bowers, Jr. ..... A42B 3/14 2/416
3,430,260 A * 3/1969 Stropkay ..... A42B 3/14 2/416
3,668,704 A * 6/1972 Conroy ..... A42B 3/122 2/413
3,849,801 A * 11/1974 Holt ..... A42B 3/121 2/413
3,878,562 A * 4/1975 Lamb ..... A42B 3/14 2/416
3,909,846 A * 10/1975 Zahn ..... A42B 3/14 2/416
3,950,788 A * 4/1976 Lamb ..... A42B 3/14 2/417
4,023,213 A * 5/1977 Rovani ..... A42B 3/121 2/413
4,035,847 A * 7/1977 Prince ..... A42B 3/14 2/416
4,293,960 A * 10/1981 Palmaer ..... A42B 3/14 2/416
4,443,891 A * 4/1984 Blomgren ..... A42B 3/00 2/209.3
5,226,180 A * 7/1993 Leach ..... A42B 1/08 2/171.1
D364,496 S * 11/1995 Lejuez ..... D2/892
5,519,895 A * 5/1996 Barnes, Jr. ..... A42B 1/08 2/422
5,887,289 A * 3/1999 Theoret ..... A42B 1/08 2/195.1
6,240,571 B1 * 6/2001 Infusino ..... A42B 3/127 2/414
7,043,761 B2 * 5/2006 Epling ..... A42B 1/069 2/181
7,096,512 B2 * 8/2006 Blair ..... A42B 1/08 2/410
D577,866 S * 9/2008 Frye ..... D29/122
7,673,350 B2 * 3/2010 Mazzoccoli ..... A42B 1/08 2/411
7,958,573 B2 * 6/2011 Lewis, Jr. ..... A42B 3/127 2/410
8,205,272 B2 * 6/2012 Green ..... A42C 5/02 2/209.13
D667,592 S * 9/2012 Vito ..... D29/122
8,966,672 B2 * 3/2015 Smith ..... A42B 3/04 2/416
8,978,167 B2 * 3/2015 Blair ..... A42B 1/08 2/410
D770,147 S * 11/2016 Byrd ..... D2/891
2003/0200598 A1 * 10/2003 Jessie ..... A42B 3/122 2/413
2010/0083421 A1 * 4/2010 Cho ..... A42B 1/008 2/171.2
2013/0000017 A1 * 1/2013 Szalkowski ..... A42B 3/127 2/414
2013/0152287 A1 * 6/2013 Cormier ..... A42B 3/124 2/459
2013/0191973 A1 * 8/2013 Pfanner ..... A42B 3/145 2/421
2014/0020158 A1 * 1/2014 Parsons ..... A42B 3/122 2/413
2014/0338104 A1 * 11/2014 Vito ..... A42B 3/127 2/414
2015/0040295 A1 * 2/2015 Pfanner ..... A42B 3/14 2/411

* cited by examiner

IMPACT REDUCTION APPAREL AND IMPACT ABSORBING LINER FOR APPAREL

RELATED APPLICATIONS

This application claims priority to and the benefit of U.S. Provisional Patent Application No. 61/978,650 filed on Apr. 11, 2014, U.S. Provisional Patent Application No. 62/119,051 filed on Feb. 20, 2015, and U.S. Provisional Patent Application No. 62/120,266 filed on Feb. 24, 2015, which are incorporated herein by reference in their entirety.

BACKGROUND

Just about every activity requires apparel, and sometimes very specific apparel, such as helmets and pads for skateboarders, in addition to standard shirts, shoes, pants, shorts, socks or any coverage that has potential for impact. Surfers often wear wetsuits. Skiers and snowboarders often wear helmets, while a number of snowboarders wear additional protection such as knee pads and wrist guards. As used herein, the term "apparel" refers not only to clothing, headgear or footwear, but also to accessories that can be worn by a person separately or with such clothing, headgear or footwear or legwear. Additionally, "apparel" refers to any covering for areas of impact on equipment or devices.

However, common impact reduction apparel, coverings or accessories are typically very bulky, cumbersome, and stand out too much for the tastes of their wearer. Thus, many people in certain activities will opt to not use any impact resistant products, which, while appearing more fashionable, put them at increased risk of injury from an impact while undergoing the activity. For example, skateboarders often eschew helmets in favor of trendy hats such as ball caps or trucker's hats. These hats provide nearly zero impact reduction.

For equipment applications, despite precautions and robust designs, the risk of an accidental impact is apparent and can be detrimental to the equipment's proper function.

Accordingly, what is needed is impact reduction apparel that can be worn with other apparel, placed over sensitive equipment, and have a low profile or be hidden altogether. Further, such impact reduction apparel can provide a platform for features that were previously impossible or very difficult to implement with conventional apparel.

SUMMARY

An impact absorbing liner for existing and custom apparel or other equipment is presented, as is apparel or accessories integrating such impact absorbing liner. The impact absorbing liner includes one or more layers of impact absorbing material. Each layer of impact absorbing material is sized and configured to be positioned over one or more critical areas of a wearer's body, which may be exposed to a risk of impact during an activity, lifestyle or equipment lifecycle. The impact absorbing liner further includes one or more connectors, for connecting various parts of the impact absorbing liner together and allowing the connection to be sized to fit any particular application. Each layer has a specific material designed for optimum comfort and impact reduction.

Creases and peripheral profiles are configured to enable flat packaging and folding for storage when product is not in use. The impact absorbing liner can be formed to a unique profile that will conform to the inside of another piece of apparel or accessory, such as inside the user's headgear, or other head-covering equipment. A thin impact absorbing liner can be applied in strategic locations to reduce the risk of damage to apparel and equipment without the need for bulky apparatuses. The impact absorbing liner can be removable and used in several garments or can be permanently integrated into an apparel or equipment product.

One aspect of the present disclosure relates to a detachable impact absorbing liner for an item of apparel. The detachable impact absorbing liner may comprise an internal frame. The internal frame may have a trunk member. The trunk member may extend from a first portion to a second portion opposite the first portion. The trunk member may include a plurality of branch members extending laterally from the trunk member. The plurality of branch members may comprise a first end branch member and a rear end branch member. At least two of the branch members that extend from opposite sides of the trunk member may have side members extending laterally from a distal end of each of the at least two of the branch members. The internal frame may further include a clasping system. The clasping system may comprise a clasping mechanism on a distal end of each of the side members and on a distal end of each adjacent branch member of the plurality of branch members. The clasping system may enable the internal frame to be shaped and fastened in a shape to conform to a shape of a wearer's body part and to be positioned within an item of apparel for that body part.

The detachable impact absorbing liner for an item of apparel comprising two or more impact resistant layers. The two or more impact resistant layers may be coupled with the internal frame. The two or more impact resistant layers may comprise a polymer layer. The polymer layer may have a first density to resist puncture and tearing. The two or more impact resistant layers may comprise an inner impact absorbing layer having a second density to resist impact. The two or more impact resistant layers may cover a majority of the internal frame. The two or more impact resistant layers may be formed with cut-ins. The cut-ins may allow the two or more impact resistant layers to conform to the shape of the wearer's body when the internal frame is shaped and fastened in the shape conforming to the wearer's body.

In some variations the item of apparel may be a sock. The clasping system may cause the internal frame to be shaped and fastened in a shape to conform with a shin of the wearer. The item of apparel may be underwear. The clasping system may cause the internal frame to be shaped and fastened in a shape to conform with a pelvic region of the wearer.

One aspect of the present disclosure relates to a detachable impact absorbing liner for an item of apparel. The detachable impact absorbing liner may comprise a frame. The frame may have a central portion. The frame may have fingers. The fingers may extend from the central portion. The fingers may have clasping members extending substantially laterally away from the end portions of the fingers. The clasping members may be configured to clasp with clasping members of adjacent fingers. The frame may be configured such that when clasped the frame conforms to the shape of a wearer's body part.

The detachable impact absorbing liner for an item of apparel may comprise two or more impact resistant layers. The two or more impact resistant layers may be coupled with the frame. The two or more impact resistant layers may comprise a polymer layer having a first density to resist puncture and tearing. The two or more impact resistant layers may comprise an inner impact absorbing layer. The inner impact absorbing layer may have a second density to resist impact. The two or more impact resistant layers may cover a majority of the frame. The two or more impact resistant layers may be formed with cut-ins to allow the two or more impact resistant layers to conform to the shape of the wearer's body part when the frame is shaped and fastened in shape conforming with the wearer's body part.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

FIG. 15 is a plan view of the assembly of an impact absorbing liner, outside looking in;

DETAILED DESCRIPTION

Figure 1:
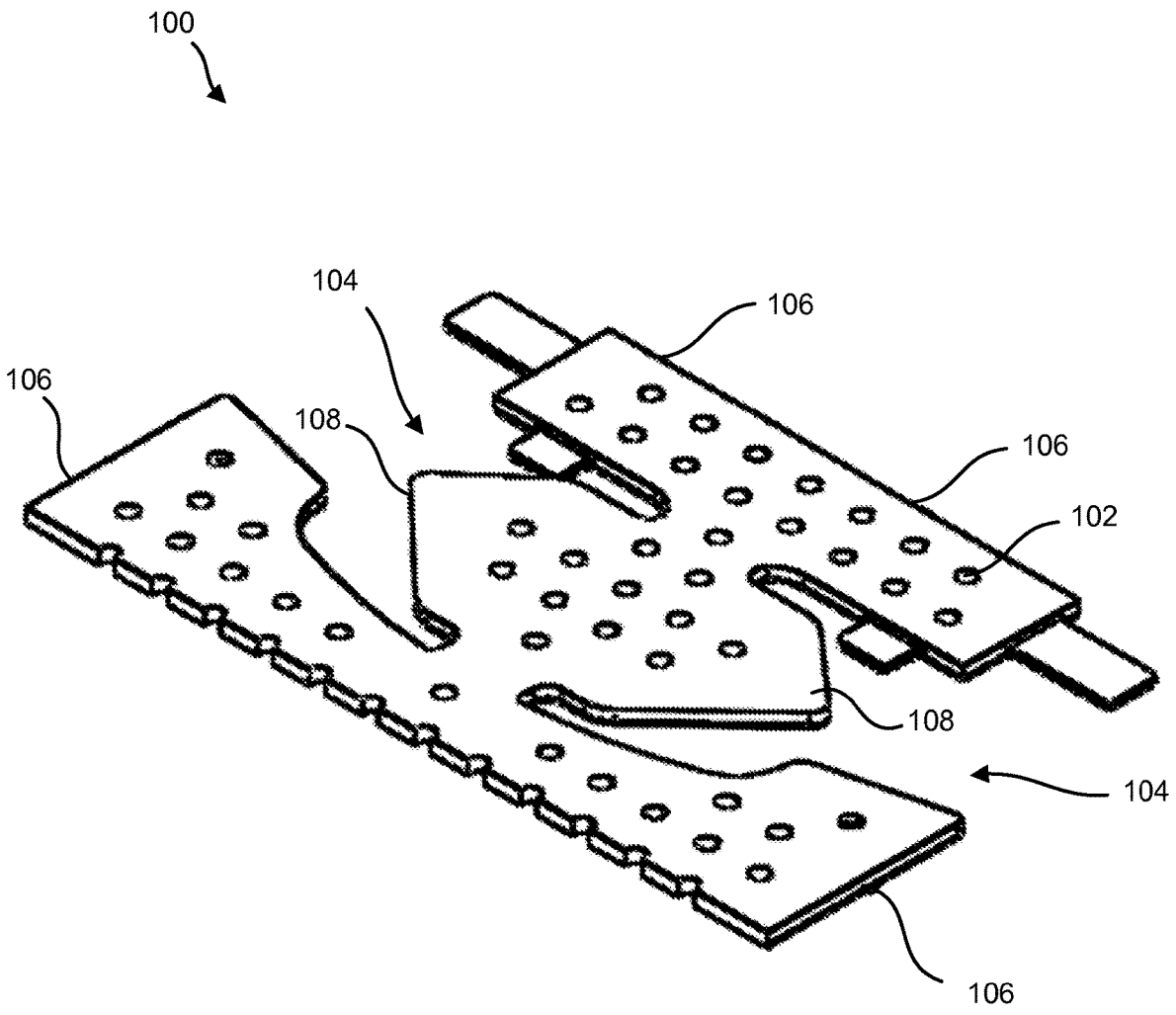
FIG. 1 is a section view of an impact absorbing liner with aeration holes.

This document describes an impact absorbing liner for existing and custom apparel and equipment. In one example, the apparel is headgear, such as a baseball cap or "trucker's cap." The impact absorbing liner includes one or more layers of impact absorbing material. Each layer of impact absorbing material is sized and configured to be positioned over critical areas of a wearer's body, such as parts of a wearer's head, which may be exposed to a risk of impact during an active lifestyle. The impact absorbing liner further includes one or more connectors, for connecting various parts of the impact absorbing liner together after the liner has been formed to confirm to the critical areas of the wearer's body, and allowing the liner to be sized to fit any particular application. One or more of the connectors can be self-adhering, or may have a connection mechanism such as a mechanical clasp (snap, button, zipper, Velcro, etc), or other mechanism.

The impact absorbing liner is wearable with other apparel or devices such that the impact absorbing liner is hidden or hide-able. The impact absorbing liner combines aesthetic design with impact protection, and can have one or more size adjustment mechanisms to allow for a universal fit.

In some implementations, the layers of impact absorbing material are rigid or semi-rigid, and can be made of so called "smart molecules" that harden on impact, open cell urethane foam rubber, closed cell urethane foam rubber, silicone elastomer, polycarbonate, Kevlar, textiles or the like, and formed to be worn with into custom and existing head gear or to fit a unique profile needed for a specific application. Accordingly, the impact absorbing liner combines aesthetic design with impact protection.

In a headgear application, the impact absorbing liner can be formed and shaped to fit at least partially or even completely within, various headgear such as helmets, hard hats, headbands, sweatbands, hoodies, beanies, skull caps, wigs, ballcaps (fitted, stretch-fit and adjustable), wetsuit caps, dry suit caps, scuba diving caps and hiking headgear. Other headgear and apparel can be used.

Other apparel applications include, but not limited to, temple protection (right or left as needed for batting and pitching applications), ear covers, elbow pads, t-shirts (long and short sleeve), sweaters, sweatshirts, undergarments (boxers, briefs, sports bra), booties, shirt or jersey with integrated sports bra, gloves, mittens, jeans, head socks (for positioning under helmet or the like), hiking boots, work-boots, designer boots, shoes, tennis shoes, running shoes, cleats, golf shoes, snowboarding boots, ski boots, socks with integrated padding in the shin, ankle or surrounding area, shin pads, ankle guards, or the like.

Applications of the impact absorbing liner can include equipment and commercial applications such as, without limitation, soccer shin guards, backpack, luggage, medical braces, casts, bandages, medical wraps, wrist guards, metatarsal insert, sole inserts, carpet padding, carpet, area rugs, blankets, seat covers, interior car side paneling, sensitive electronic cabinets, storage boxes, military communication systems, radar components, sonar components or the like. Regardless of application, the impact absorbing liner can be manufactured and shipped flat to minimize warehousing requirements for high volume applications.

Impact Absorbing Liner:

In exemplary implementations, the impact absorbing liner can be designed to be integral with a headgear article, or removable to meet a variety of application requirements. The impact absorbing liner can be formed to stand freely on its own in a shape desired for end use. The impact absorbing liner can be configured to lay flat for streamlined packaging and shipping before use. The impact absorbing liner can be made from one or more layers of a variety of impact absorbing materials such as open cell urethane foam rubber, closed cell urethane foam rubber, silicone elastomer, Kevlar, polycarbonate or alike, and which can be formed of any thickness, density and profile to provide maximum impact resistance while remaining thin, light weight and low profile. The material can maintain elasticity, which can then be used as a fine adjustment and as a security feature to hold the impact absorbing liner in a desired position when in use.

FIGS. 1-29 illustrate exemplary implementations of the disclosed technology. In some exemplary implementations, as illustrated in FIGS. 1-29, an impact absorbing liner is provided for application to headgear. The headgear can include, without limitation, ball caps, beanies, hoodies, military style hats, or the like. The impact absorbing liner can be either universal or one-sized, or custom designed for specific applications. For instance, snap back and fitted ball caps may both use one common size and design.

Figure 2:
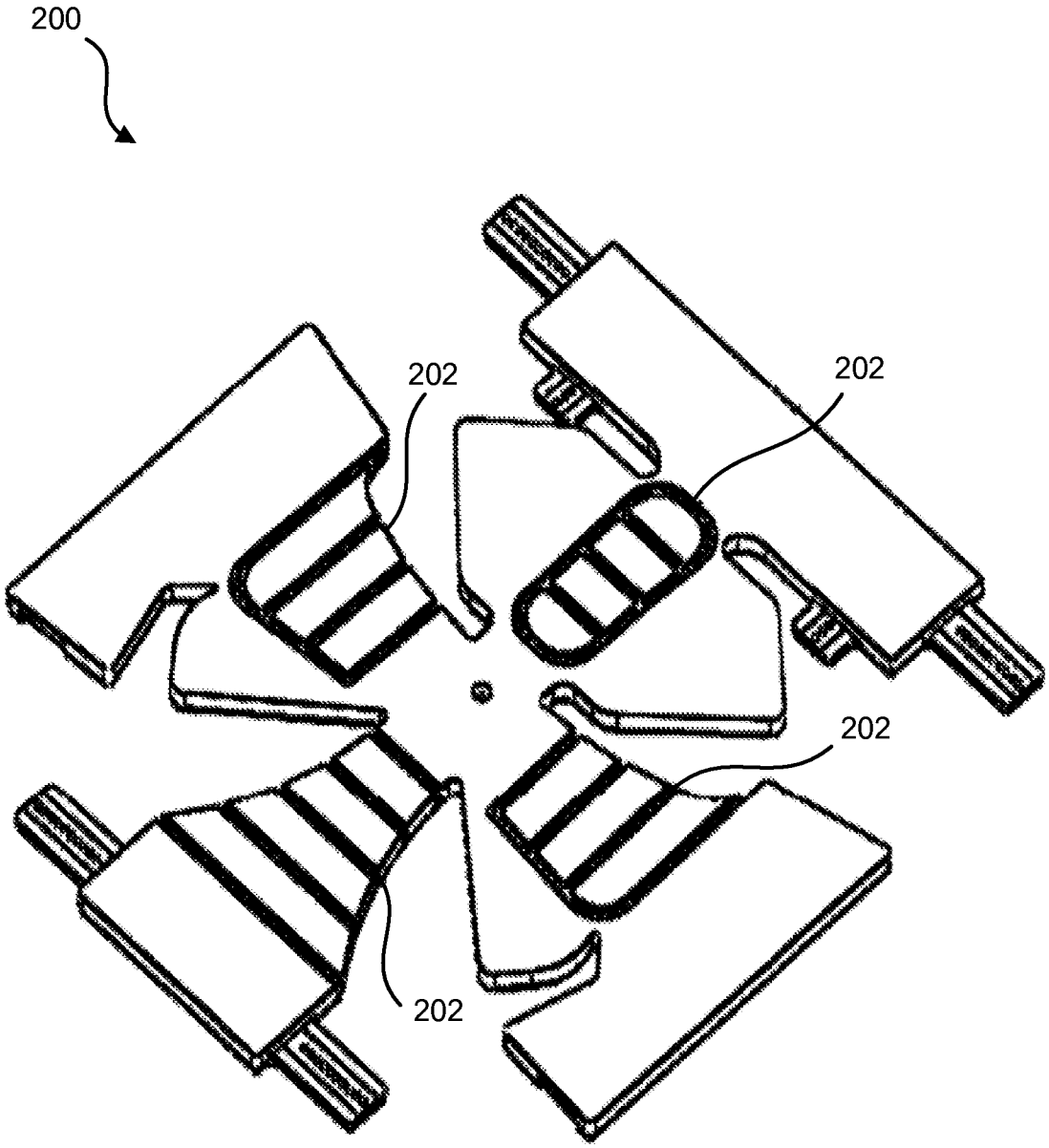
FIG. 2 is an isometric view of an impact absorbing liner with flex/vent grooves.
Figure 3:
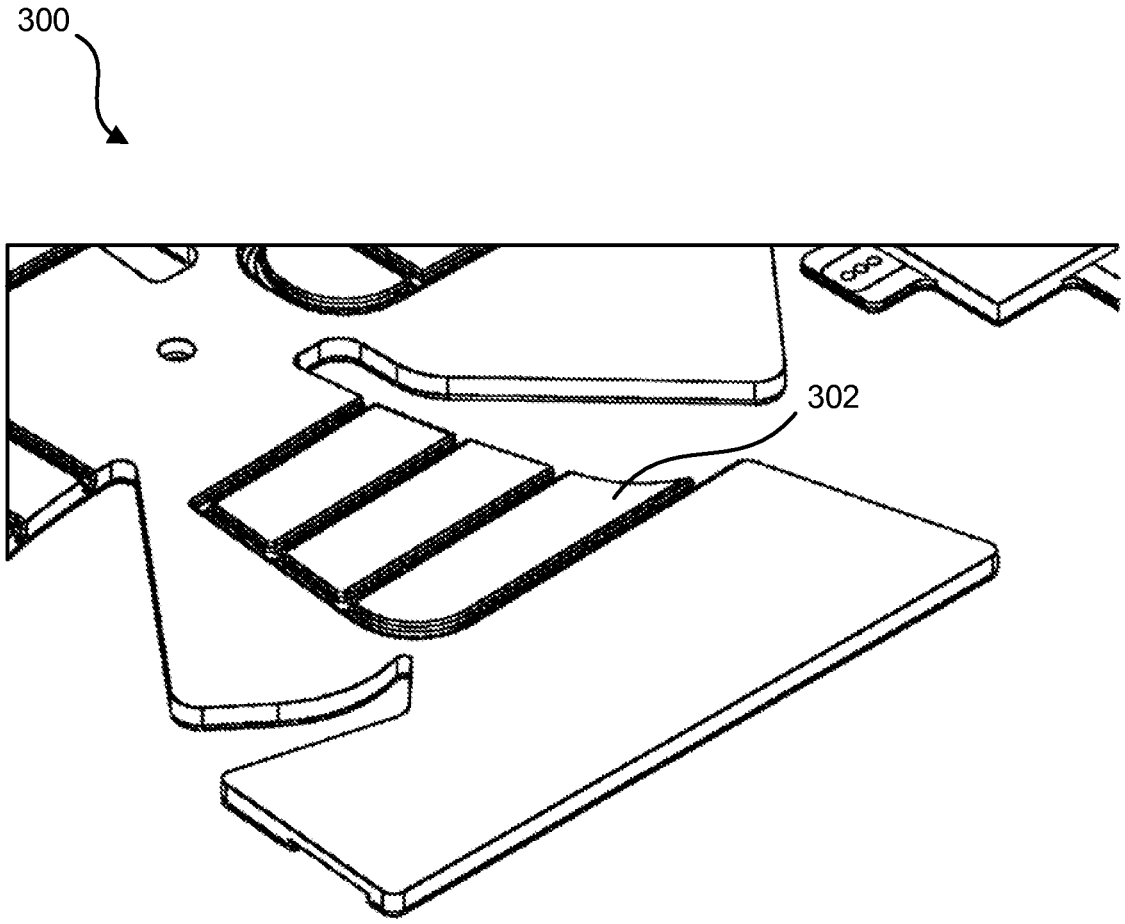
FIG. 3 is a detailed view of the flex/vent grooves of an impact absorbing liner.

FIG. 1 is a cut-away section view of an impact absorbing liner 100 with aeration holes 102. The impact absorbing liner 100 includes cut-in sections 104 that define laterally-extending arms 106 or coverage regions 108 of the one or more layers of impact absorbing materials. FIG. 2 is an isometric view of an impact absorbing liner 200 with flex/vent grooves 202 that are formed into the one or more layers of impact absorbing materials. In some instances, the flex/vent grooves 202 can be used in addition to, or in lieu of, the aeration holes 102 through the impact absorbing liner 100. FIG. 3 is a detailed view of flex/vent grooves 302 of an impact absorbing liner 300, consistent with that shown in FIG. 2. Each flex/vent groove 302 can be formed into one or more of the layers of impact absorbing materials, preferably leaving at least one layer of the material intact.

Figure 4:
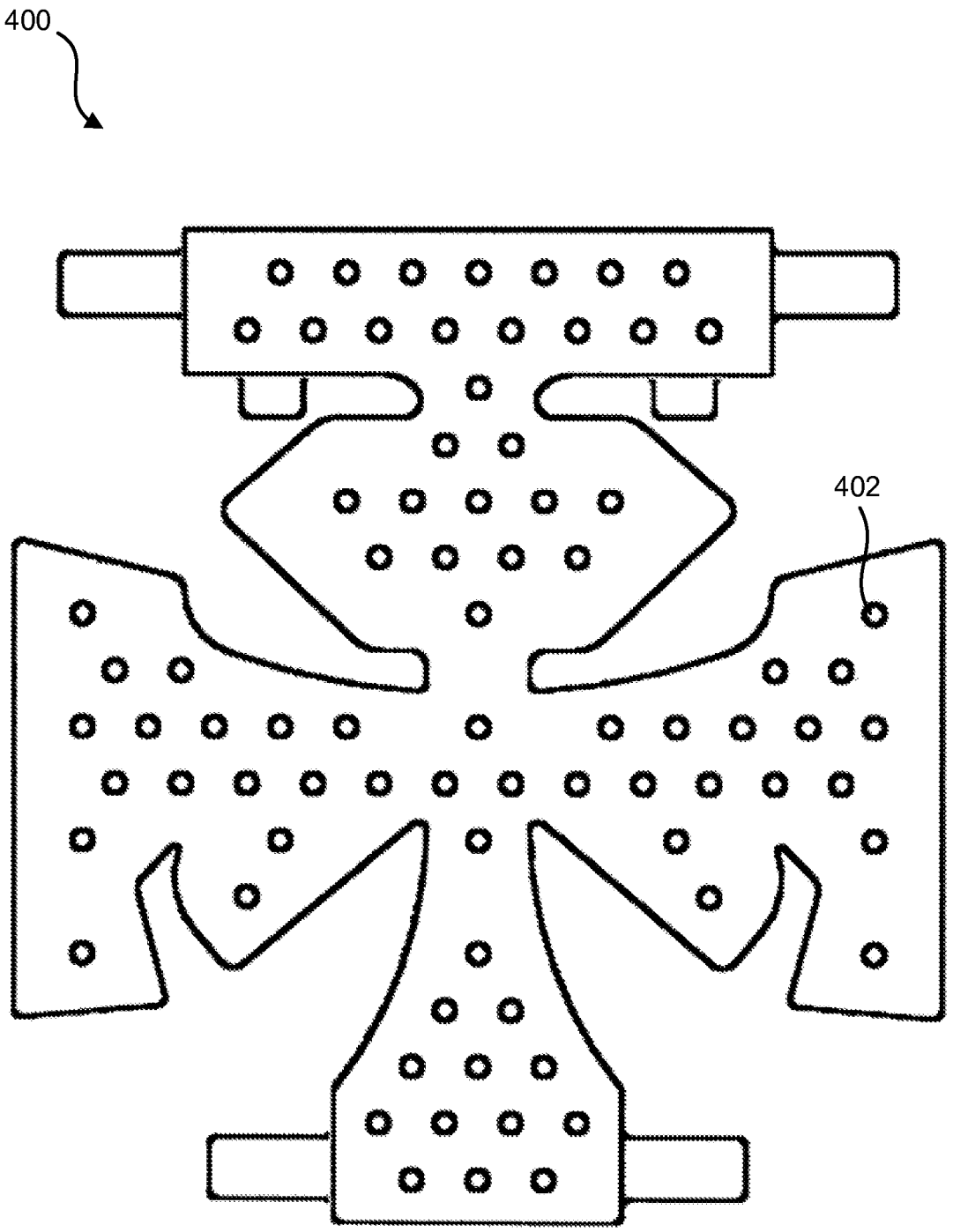
FIG. 4 is a plan view of an impact absorbing liner showing aeration holes.

FIG. 4 is a plan view of an impact absorbing liner 400 with aeration holes 402, and illustrating a preferred cut-out shape of the impact absorbing liner 400 in an un-assembled form, i.e. as cut with a die or pressed from a mold for shipping and prior to being formed into a semi-spherical shape to be worn as an impact absorbing liner for a piece of headgear, such as a hat or cap. The aeration holes 402 can be applied as needed based on a desired breathability of the selected material. If a solid gel elastomer is used, aeration holes can be applied to provide adequate ventilation and avoid overheating the user. Conversely, if a breathable open cell foam material is applied, the material itself will provide breathability and maximize the available surface area for the absorbing material.

Figure 5:
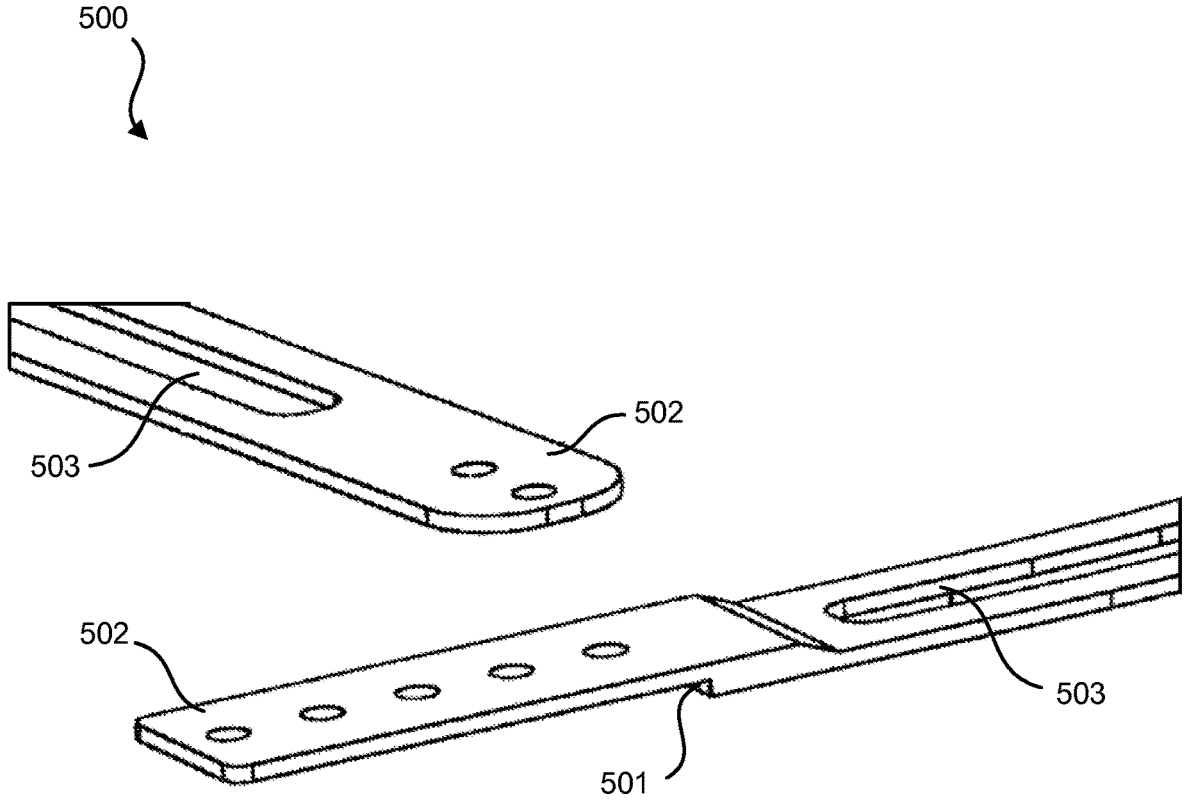
FIG. 5 illustrates an adjustable clasp.

FIG. 5 illustrates a portion of a internal frame having a fastening device such as an adjustable clasp 500 with recess 501 to allow for a flat assembly. Fasteners 502, which can be snaps, clasps, pins and corresponding holes, or the like, provide a mechanism with which to attach the frame creating and maintaining a curved shape. Slots 503 eliminate material where it is not needed for performance and allow reduced weight for the final assembly. The, adjustable clasp 500 may or may not be integral with the structural frame, and provides a foundation to fasten the entire assembly together. In some implementations, the adjustable clasp 500 can have a range of adjustability to cover the full range of adult and children sizes. In some implementations, the adjustable clasp 500 includes a snap-fit clasp that allows for easy adjusting while providing a secure closure. Elastic straps and or hook and loop fasteners can also be used in strategic locations, such as slots 503, to allow for a snug, universal fit of the impact absorbing liner, via adjustment of the structural frame, as needed.

Figure 6:
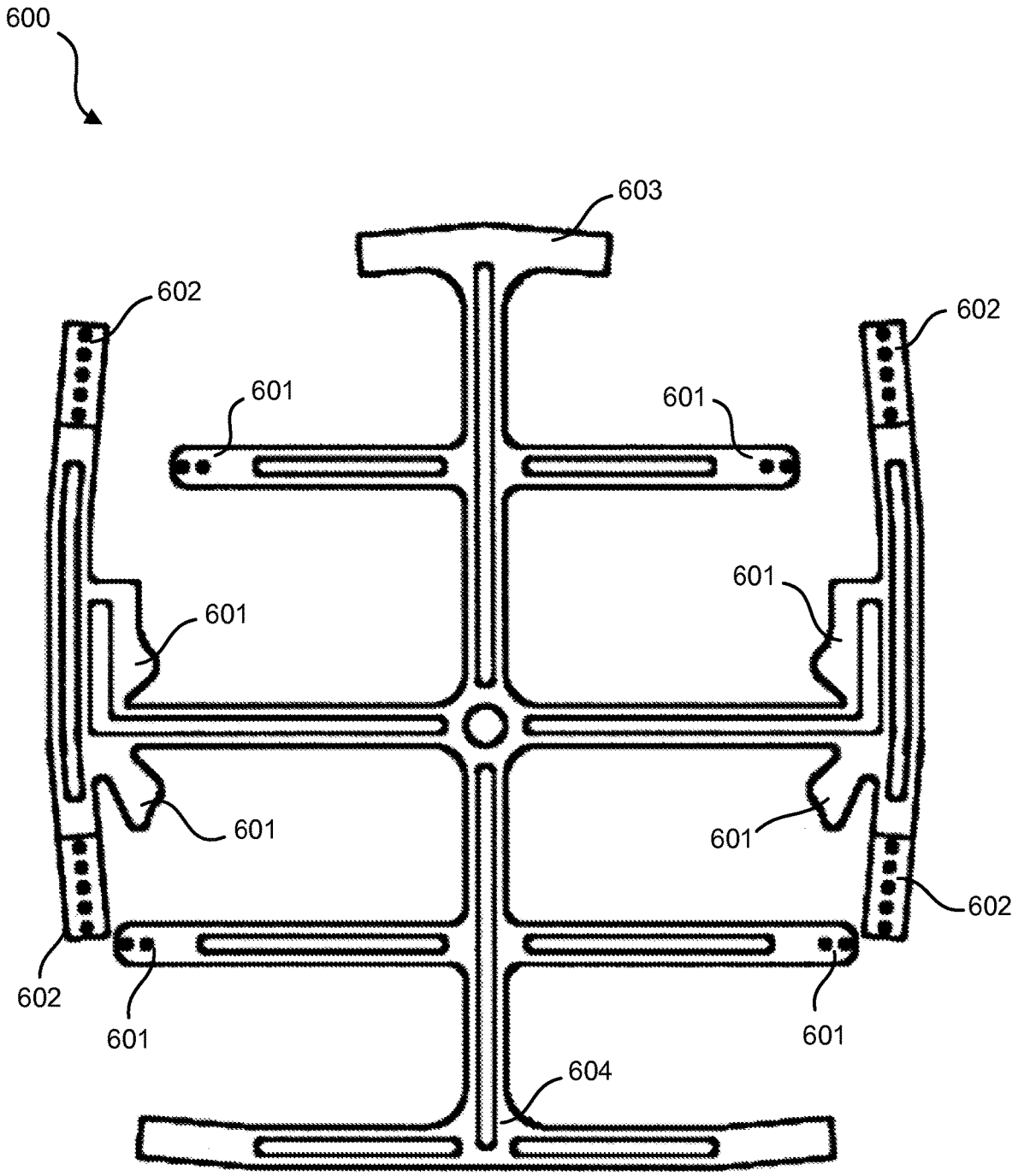
FIG. 6 illustrates an internal frame of an impact absorbing liner, inside looking out.

FIG. 6 illustrates an internal frame 600 of an impact absorbing liner, inside looking out. First fasteners 601 secure the frame to maintain lateral shape and secure to the wearer's head. Second fasteners 602 secure the internal frame 600 to maintain circumferential shape and allow adjustability to secure to various head shapes and sizes. First and second fasteners 601 and 602 enable adjustments necessary to make the product universal to fit a range of head shapes and sizes.

Figure 7:
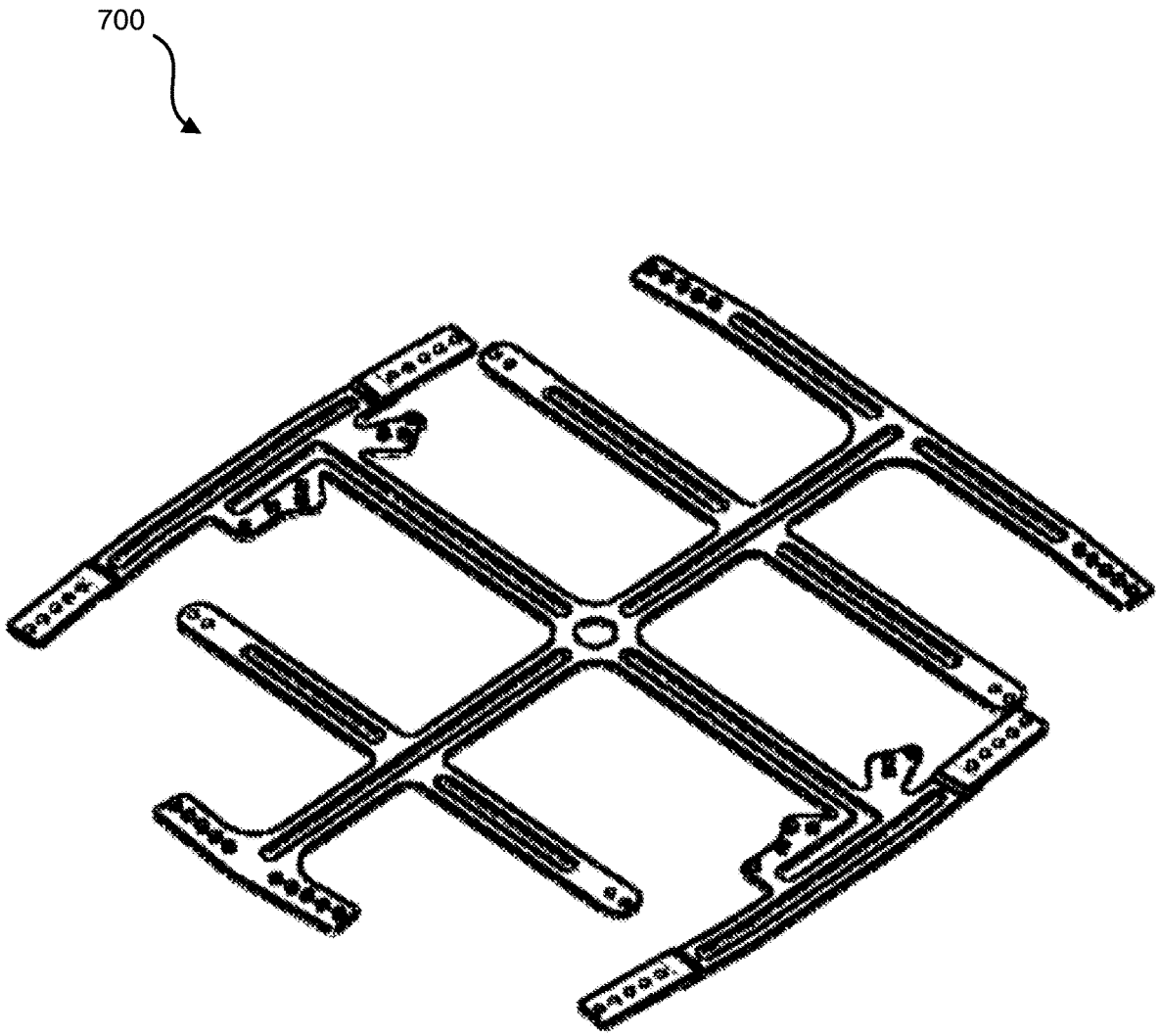
FIG. 7 illustrates an internal support structure of an impact absorbing liner.
Figure 8:
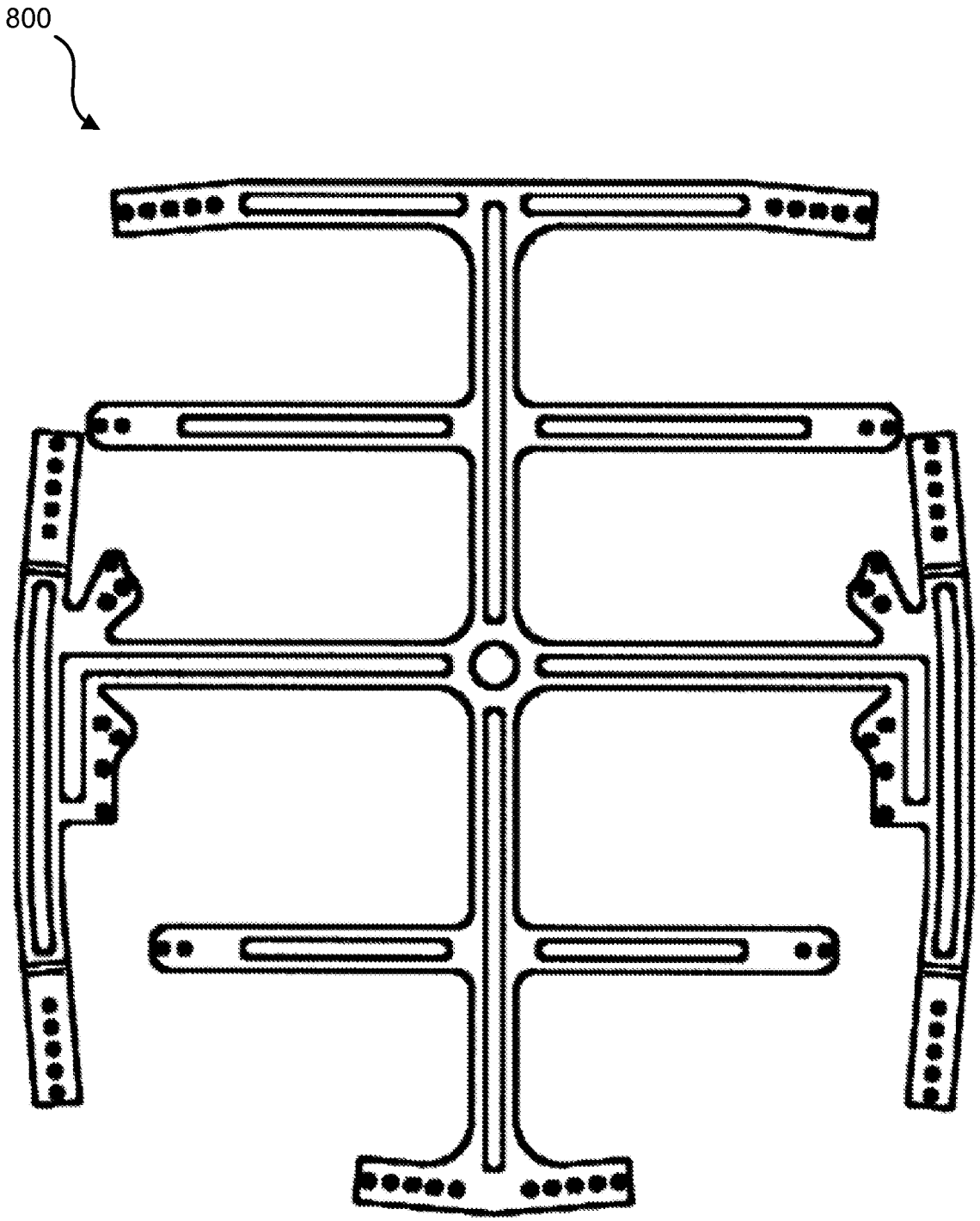
FIG. 8 illustrates another internal support structure of an impact absorbing liner.

FIG. 7 illustrates an isometric view of an internal frame 700 to provide a support structure of an impact absorbing liner. FIG. 8 illustrates a plan view of an internal frame 800 of an impact absorbing liner. The internal frame 700 or 800 can be formed of, without limitation, one or more of polycarbonates, Kevlar, fiberglass, polyethylene, polypropylene, vinyl, or the like and which provides puncture and abrasion resistance in addition to structural support for a self-supporting product. The internal frame 700, 800 also allows for a wider range of liner materials. For instance, using soft liner materials without an internal frame may weaken the assembly and hinder protection due to the liner material shifting around instead of staying in position.

The internal frame 700, 800 can be formed to spring out and conform to the shape of the apparel within which it is placed as needed to suit the specific application. Additionally, the internal frame 700, 800 can be pre-formed, using thermoforming or similar press process, to create a unique shape to which the softer, impact absorbing layers will conform. This provides a stable and standalone structure with a secure and contoured fit into the receiving apparel. By using the internal frame 700, 800, the assembly can be either removable or integrated within the impact absorbing liner during manufacturing. The internal frame 700, 800 also provides a base or foundation for the adjustable clasp for the user to easily store the impact absorbing liner when not in use and in a flattened configuration, for quick assembly when needed. The adjustable clasp also provides a mechanism to securely attach the liner to the area requiring protection.

In some implementations, the internal frame 700, 800 can include a locating hole to provide alignment points for use during over mold or assembly of the liner during the manufacturing process. These holes, in conjunction with the adjustable clasp, can ensure proper alignment of the assembly during manufacturing. The internal frame 700, 800 can be collapsible or manufactured in multiple parts to allow for quick folding and storage of the impact absorbing liner when traveling, shipping or not in use.

The internal frame 700, 800 adds an additional layer of protection to resist against punctures in strategic locations. The internal frame 700, 800 can also have thicker sections or multiple layers at strategic locations on the frame. Outer edges can be raised or corrugated to achieve the desired rigidity while minimizing added weight. The internal frame 700, 800 can also provide an alternative path for impact load dispersion. Instead of an impact being focused on the immediate contact area, the internal frame 700, 800 can act as a dispersion element and help absorb and dissipate the force.

In addition to thickness variations, the material properties can also be varied throughout the internal frame 700, 800. Inserting sections with higher elasticity properties, the versatility and adjustment of the frame is increased. The amount of mechanical adjustment needed can be reduced and replaced with elastic allowances and impact absorbing qualities in the material itself. Some applications may also require a more rigid section for either support or increased protection. This property can also be varied during internal frame manufacturing.

The internal frame 700, 800 can be formed or manufactured in various colors and textures to suit the branding and marketing demands. Color variations can be custom suited to various logos, applications and styles. Transparent and opaque shades can also be used for either demonstration purposes or for aesthetic reasons as needed. Texture can be varied as well to suit the specific application. Some textures will be better suited for adding layers or material, covering in cloth or other casing than textures used with the raw base material and inside another hat or garment. The internal frame 700, 800 can be made of a rigid or semi-rigid plastic, polycarbonate, polyethylene, polypropylene, vinyl, carbon fiber, a metal mesh, or metal wire, or the like.

The internal frame 700, 800 need not be "internal" to other layers of the impact absorbing liner, and can be applied to either exterior surface of the impact absorbing liner. This configuration can be applied in addition to the internal frame 700, 800 as mentioned herein and can serve to act as a hard shell for protection and rigidity. As an external frame, the frame can be made up of multiple sections to allow for increased flexibility. Each section can be mechanically attached and either be applied as a single piece or as multiple pieces. Multiple pieces of the frame can be hinged or connected together in a chain configuration where the rotational axis is aligned accordingly to provide flexibility in the desired direction and limit movement as needed.

Figure 9:
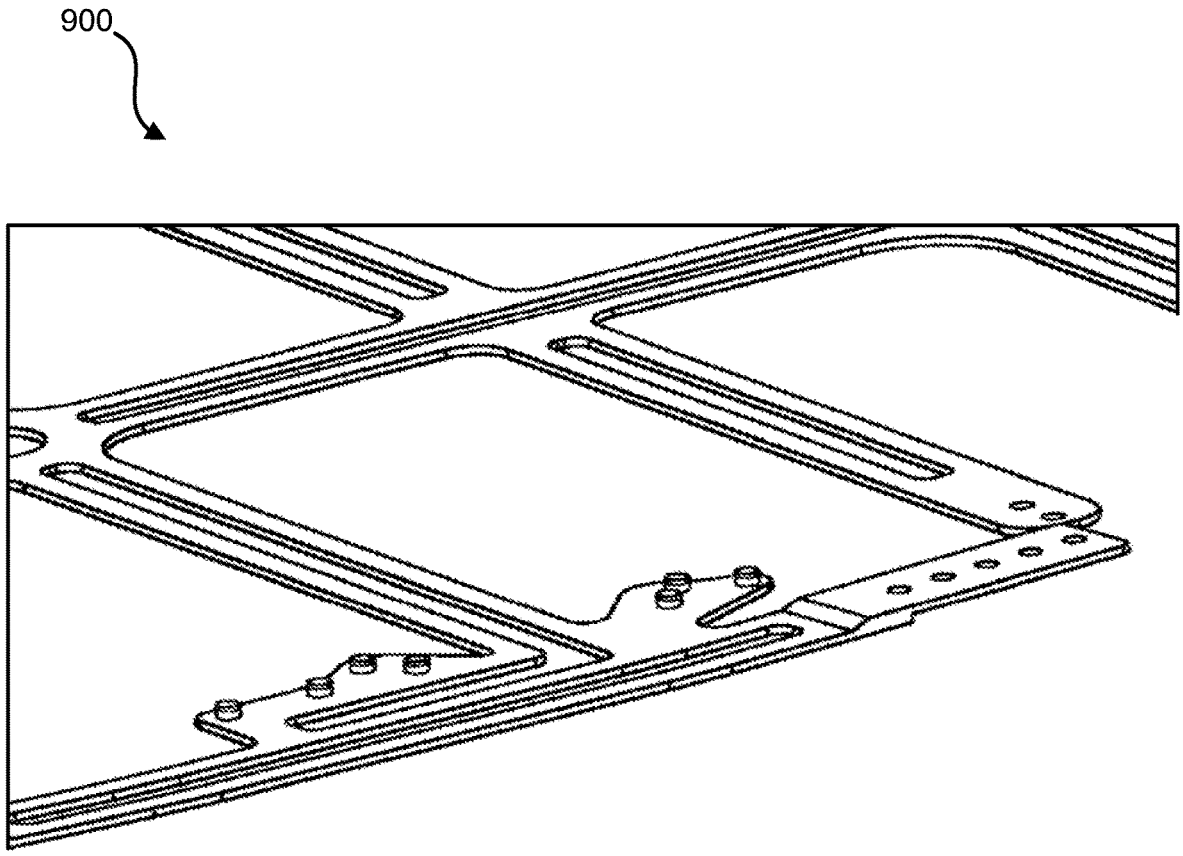
FIG. 9 illustrates a close-up view of a snap-fit detail of the internal support structure of an impact absorbing liner.

FIG. 9 illustrates a close-up view of a snap fit of the internal frame 900 of an impact absorbing liner, in accordance with some implementations, and as substantially described above.

Figure 10:
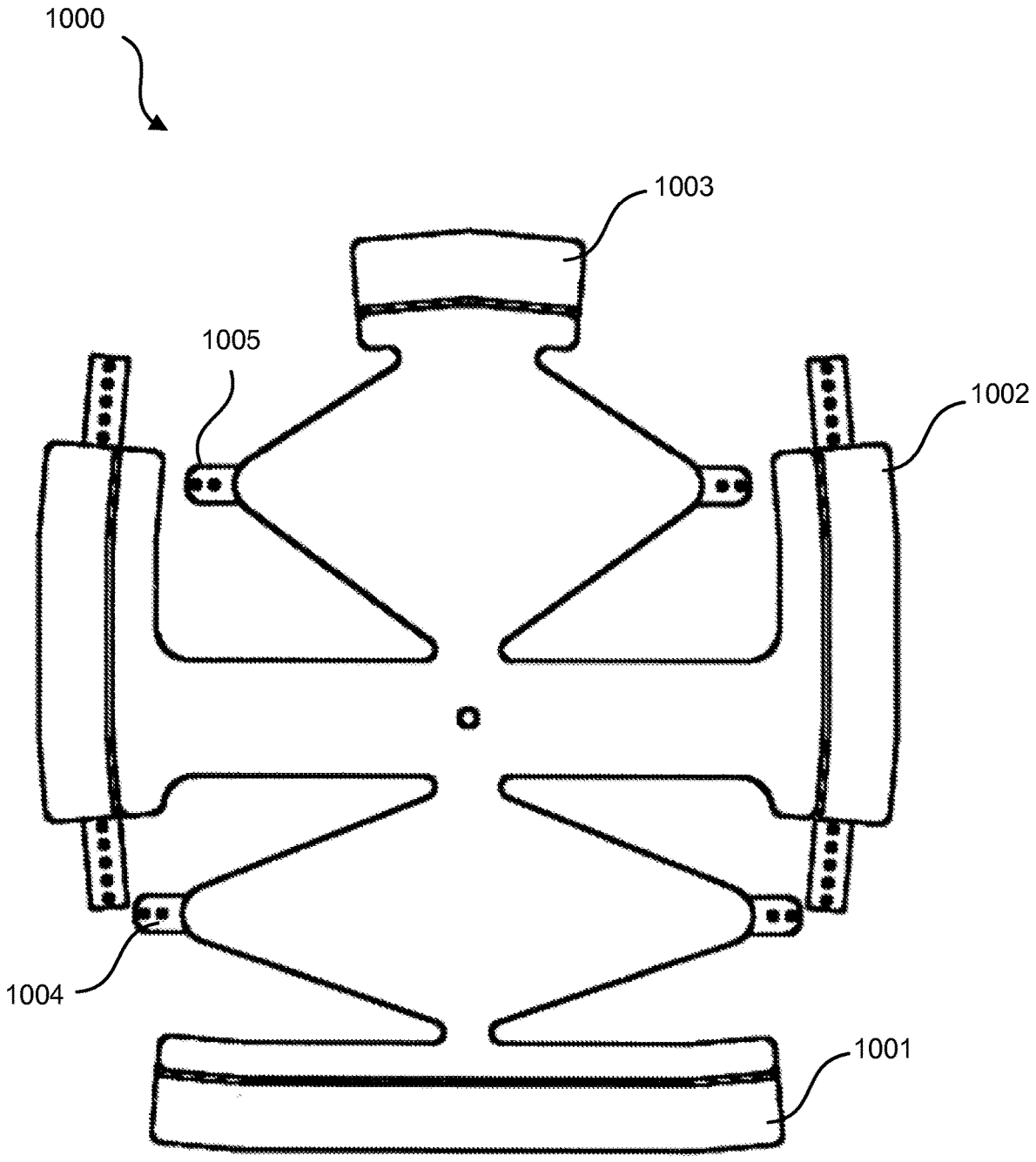
FIG. 10 is a plan view of an impact absorbing liner, inside looking out.
Figure 11:
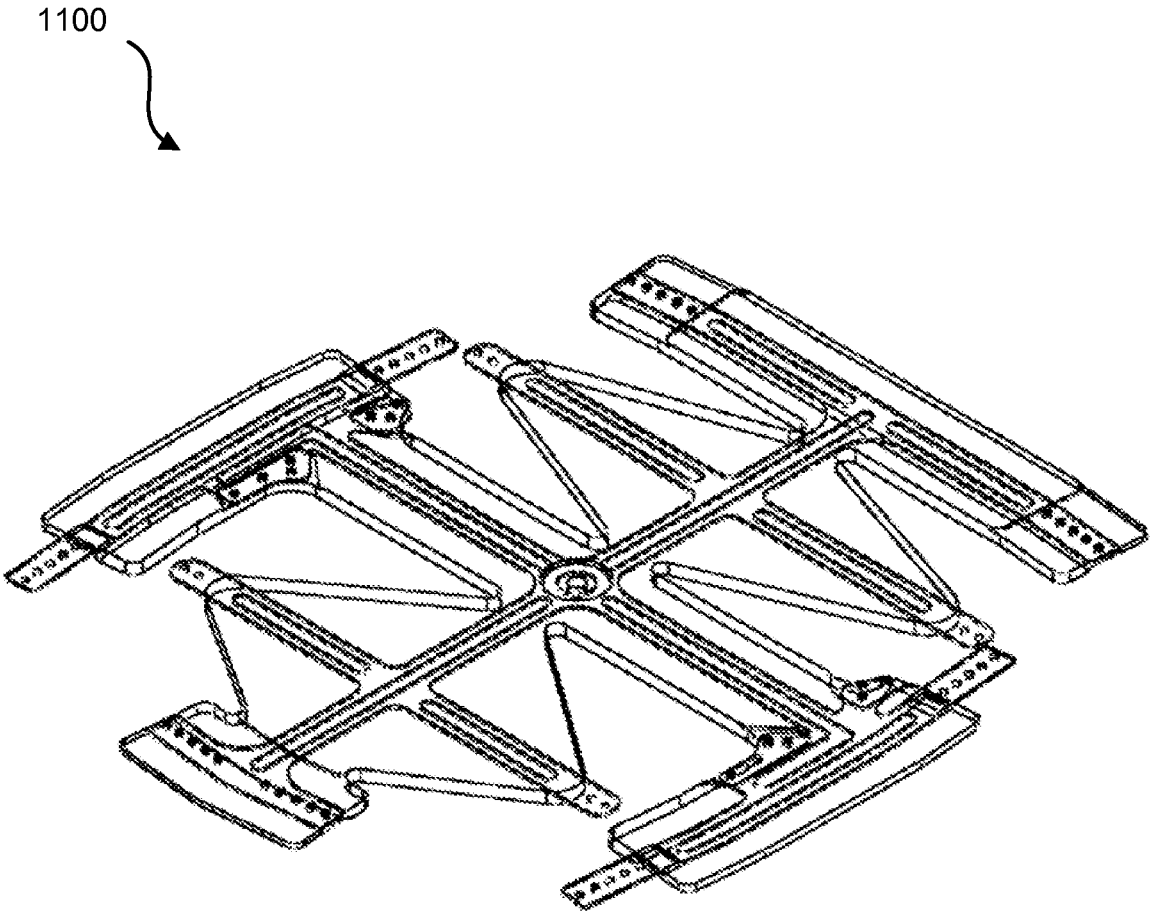
FIG. 11 is a transparent view of the assembly showing an integral internal frame.

FIG. 10 shows a plan view of an assembled impact absorbing liner 1000, inside looking out. Undercut 1001, 1002 and 1003 allow space to accommodate for the thickness of a sweat band and maximize fit and comfort when inserted into a hat, for example. Adjustable clasp mechanisms 1004 and 1005 extend from the various extending members for allowing a customized fit. FIG. 11 is a transparent view of the assembly showing an integral internal frame 1100, and shows the over mold of the frame and the impact absorbing liner.

Figure 12:
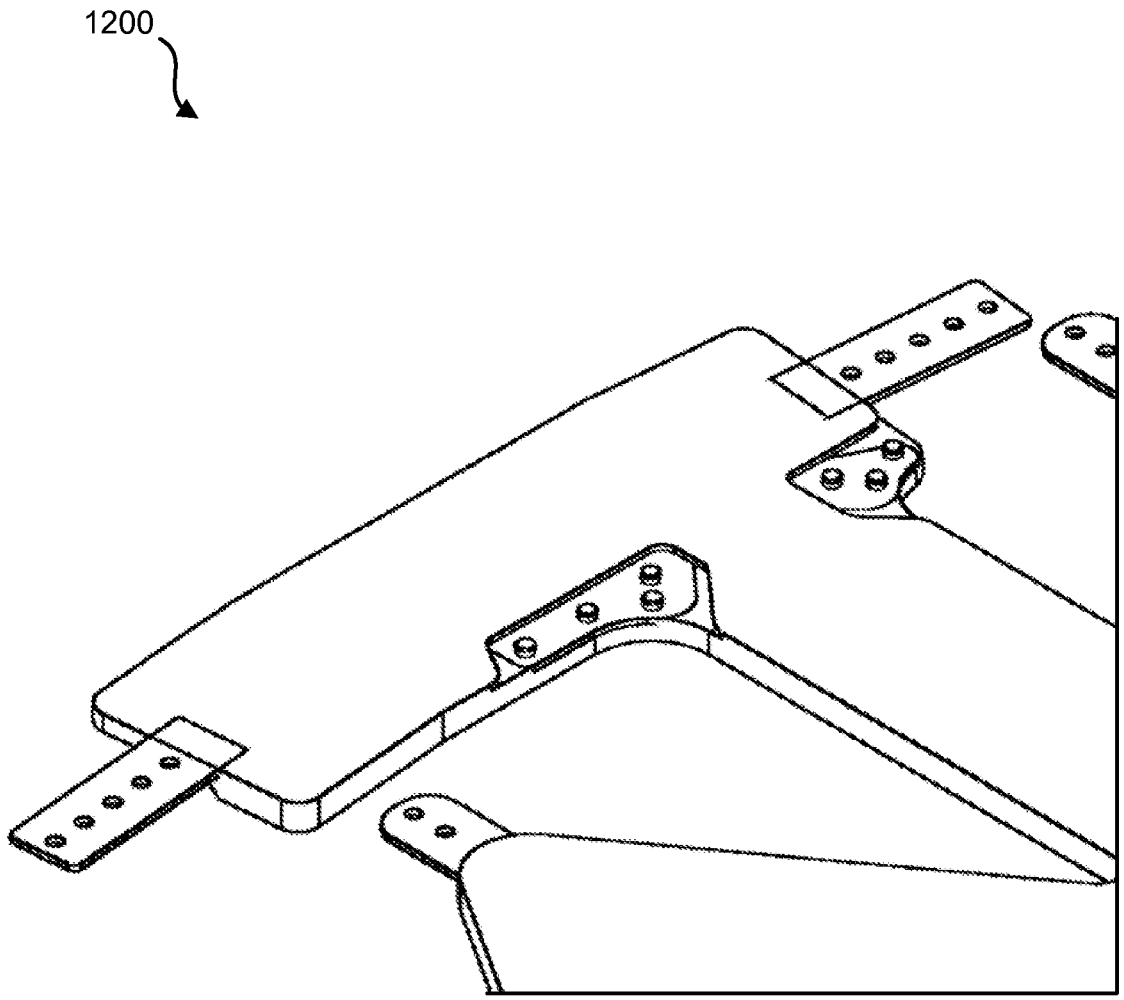
FIG. 12 is an assembly view of an impact absorbing liner showing a close-up of a snap closure with adjustable features.
Figure 13:
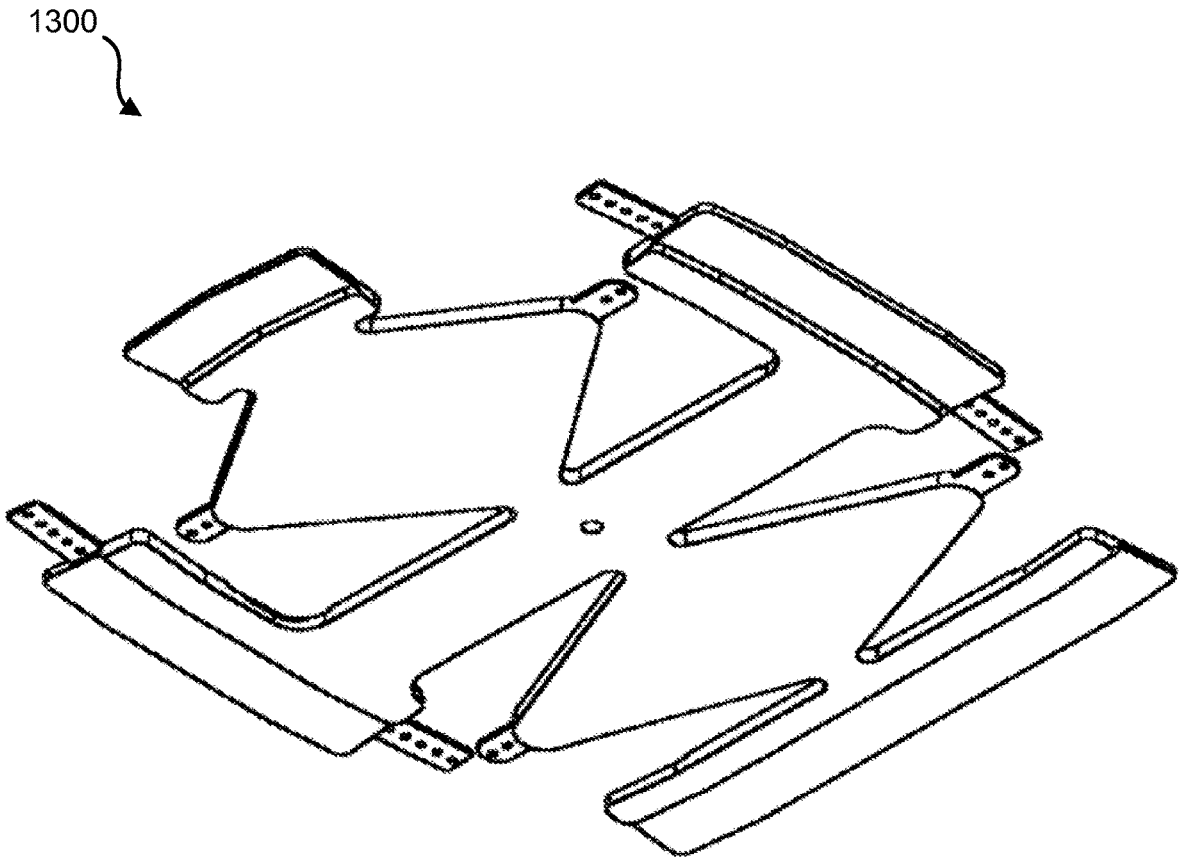
FIG. 13 is an isometric view of an assembly of an impact absorbing liner, inside looking out.
Figure 14:
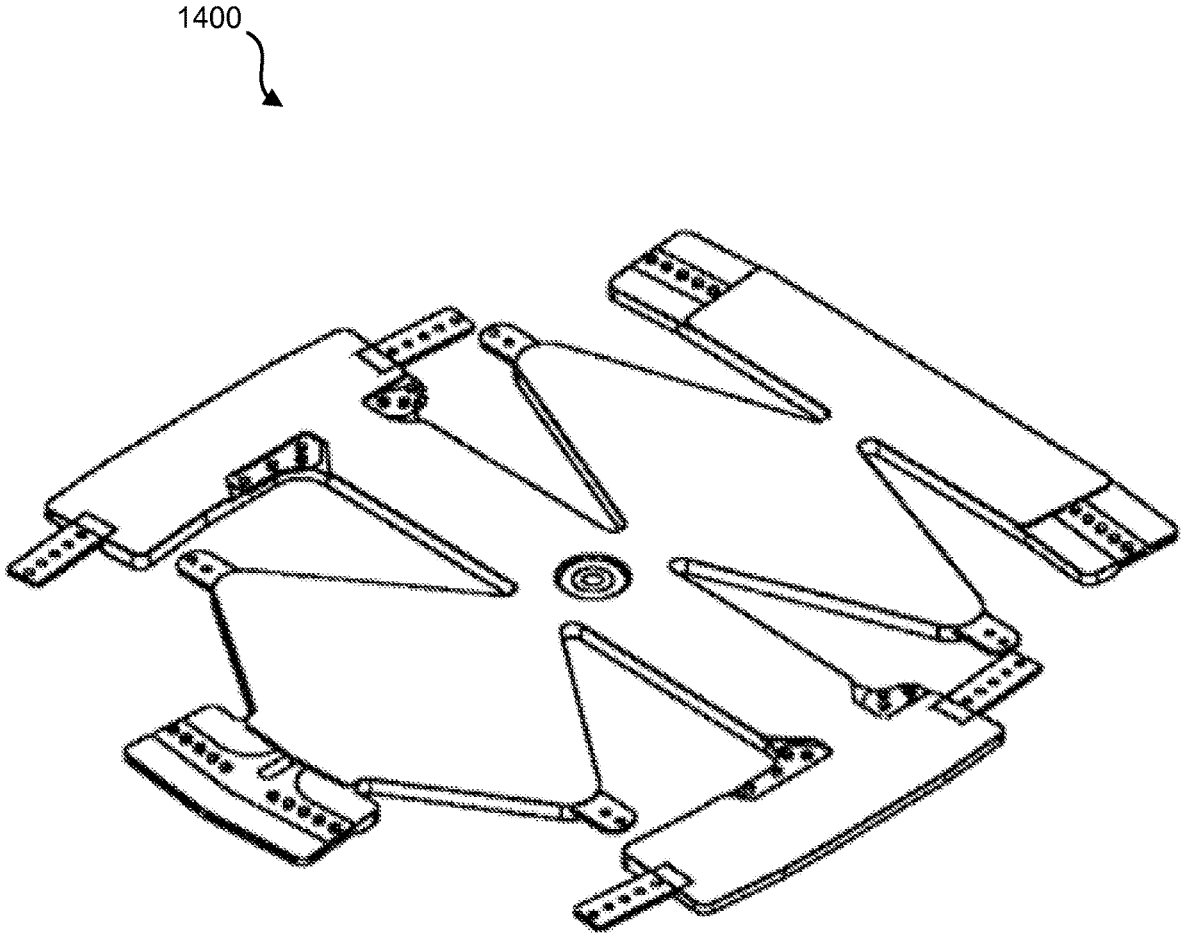
FIG. 14 is another isometric view of the assembly.
Figure 15:
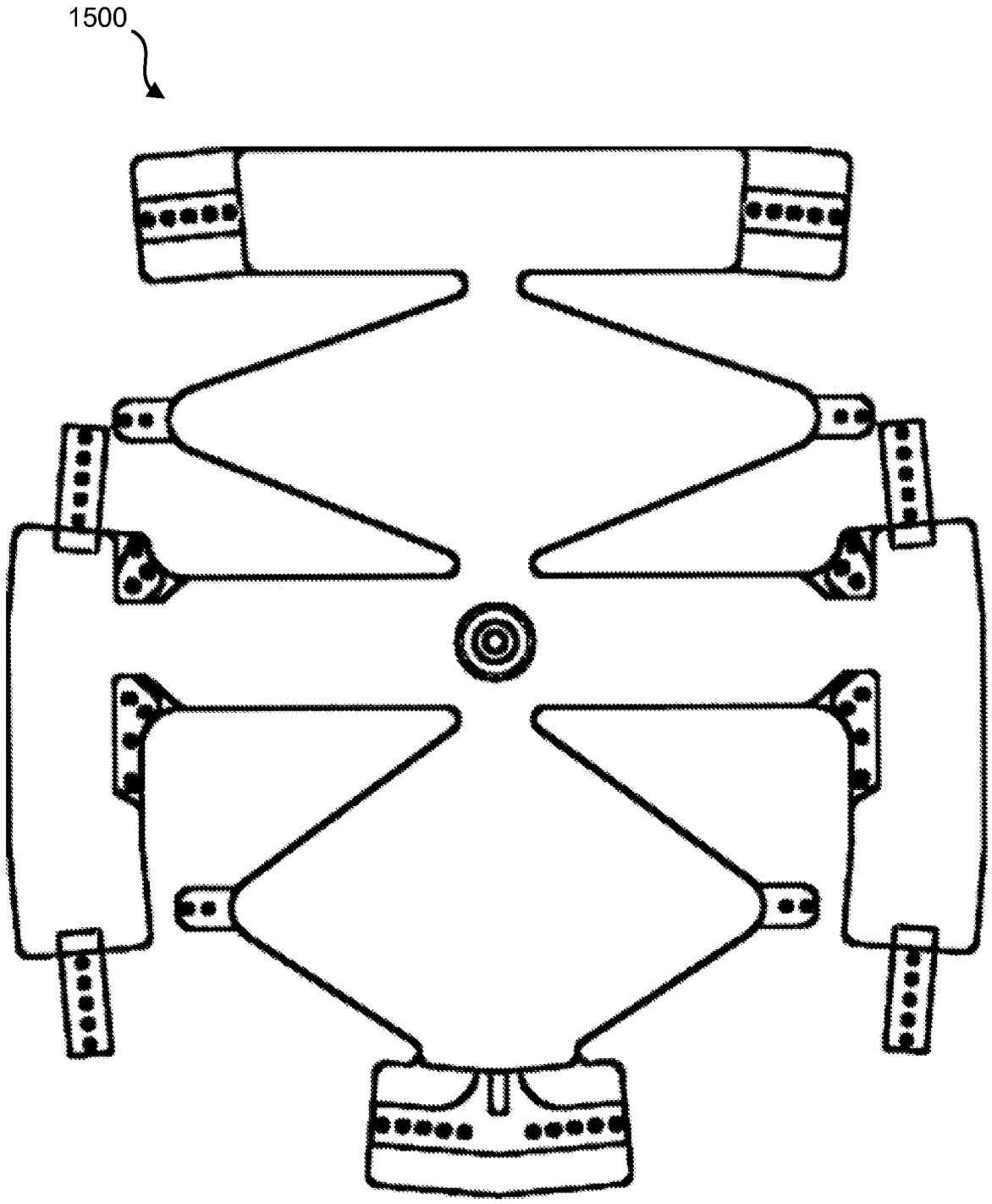

FIG. 12 is an assembly view 1200 of an impact absorbing liner showing a close-up of a snap closure with adjustable features. FIG. 13 is an isometric view of an assembly 1300 of an impact absorbing liner with integral support frame, from the inside looking out. FIG. 14 is another isometric view of an assembly 1400, from the outside looking in. FIG. 15 is a plan view of an assembly of an impact absorbing liner 1500, from the outside looking in.

Figure 16:
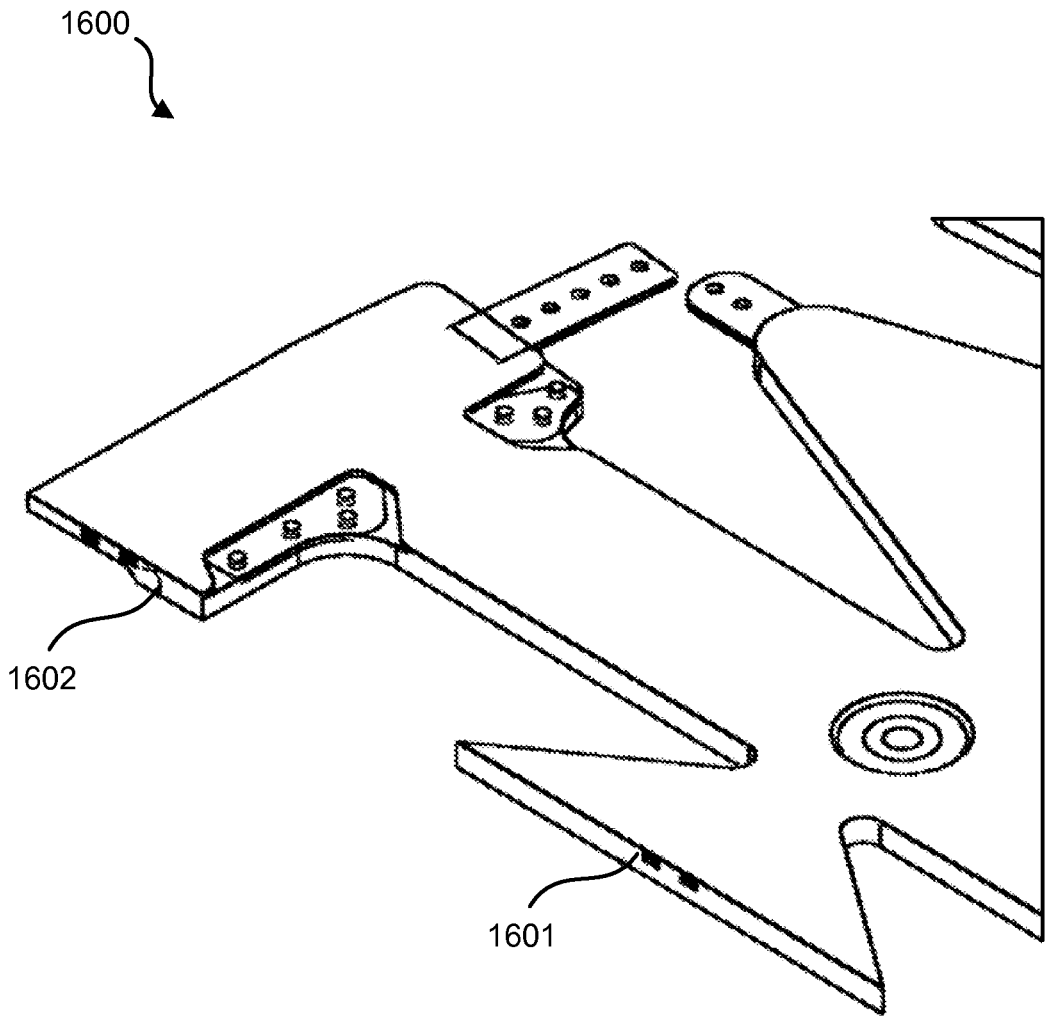
FIG. 16 is an isometric section view showing integral internal structure within an impact absorbing liner.

FIG. 16 is an isometric section view showing integral internal structure within an impact absorbing liner 1600. The impact absorbing liner 1600 includes an internal frame having extending frame arms 1601 and 1602.

Figure 17:
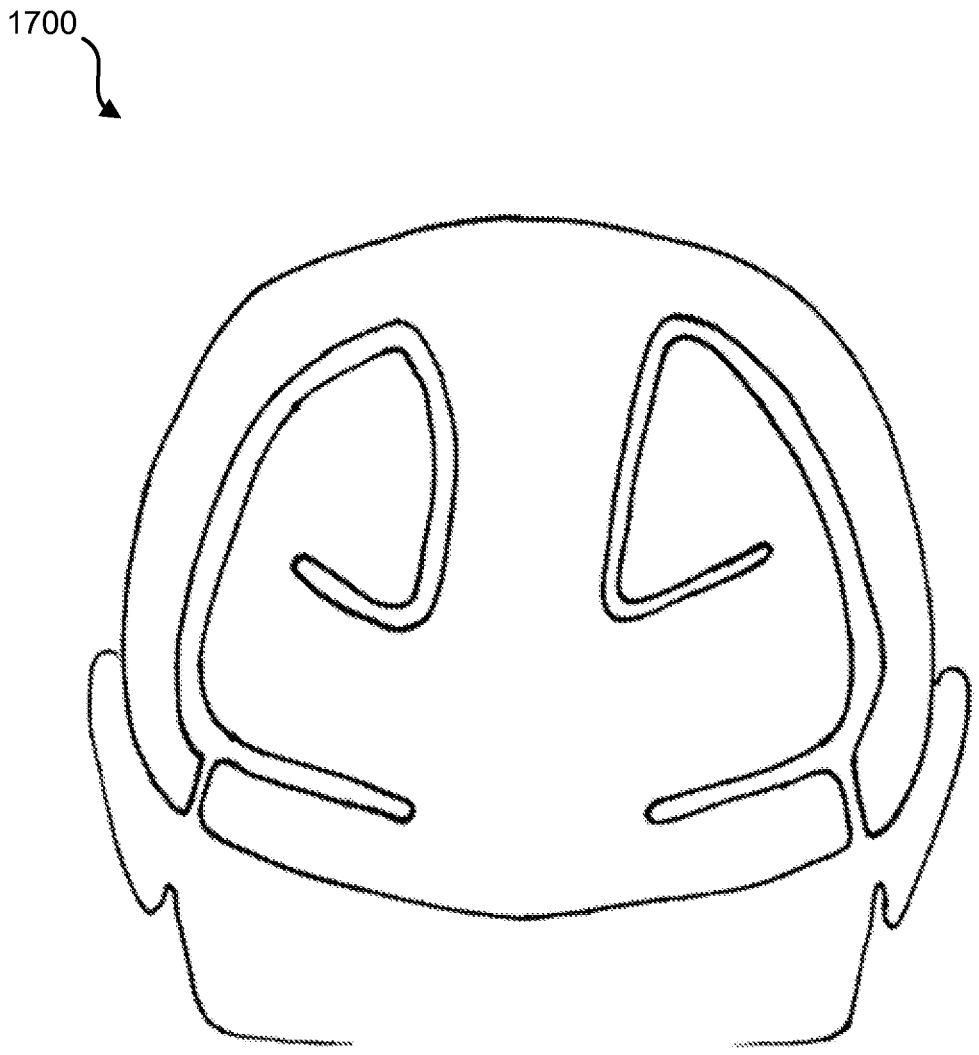
FIG. 17 illustrates a rear view of an impact absorbing liner.
Figure 18:
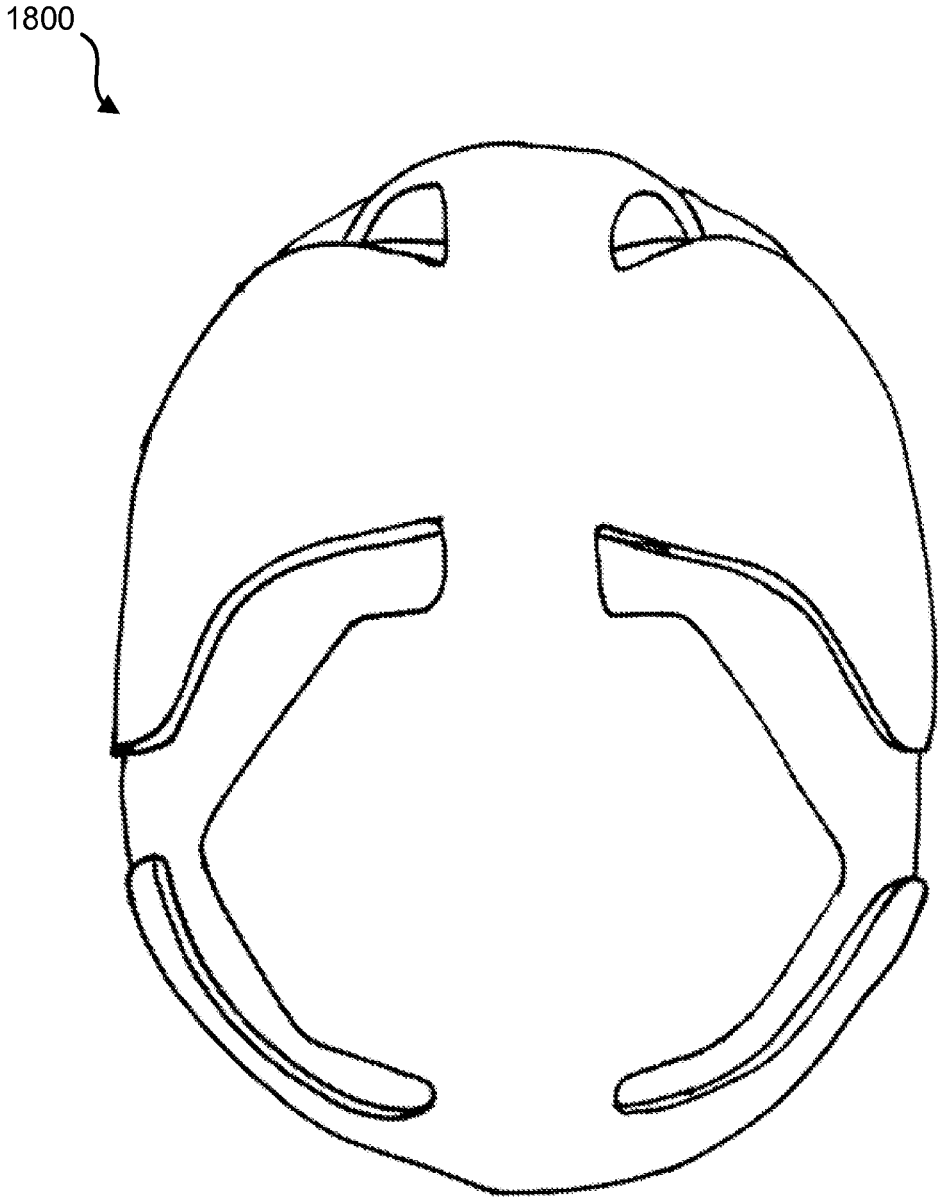
FIG. 18 illustrates a top view of an impact absorbing liner.
Figure 19:
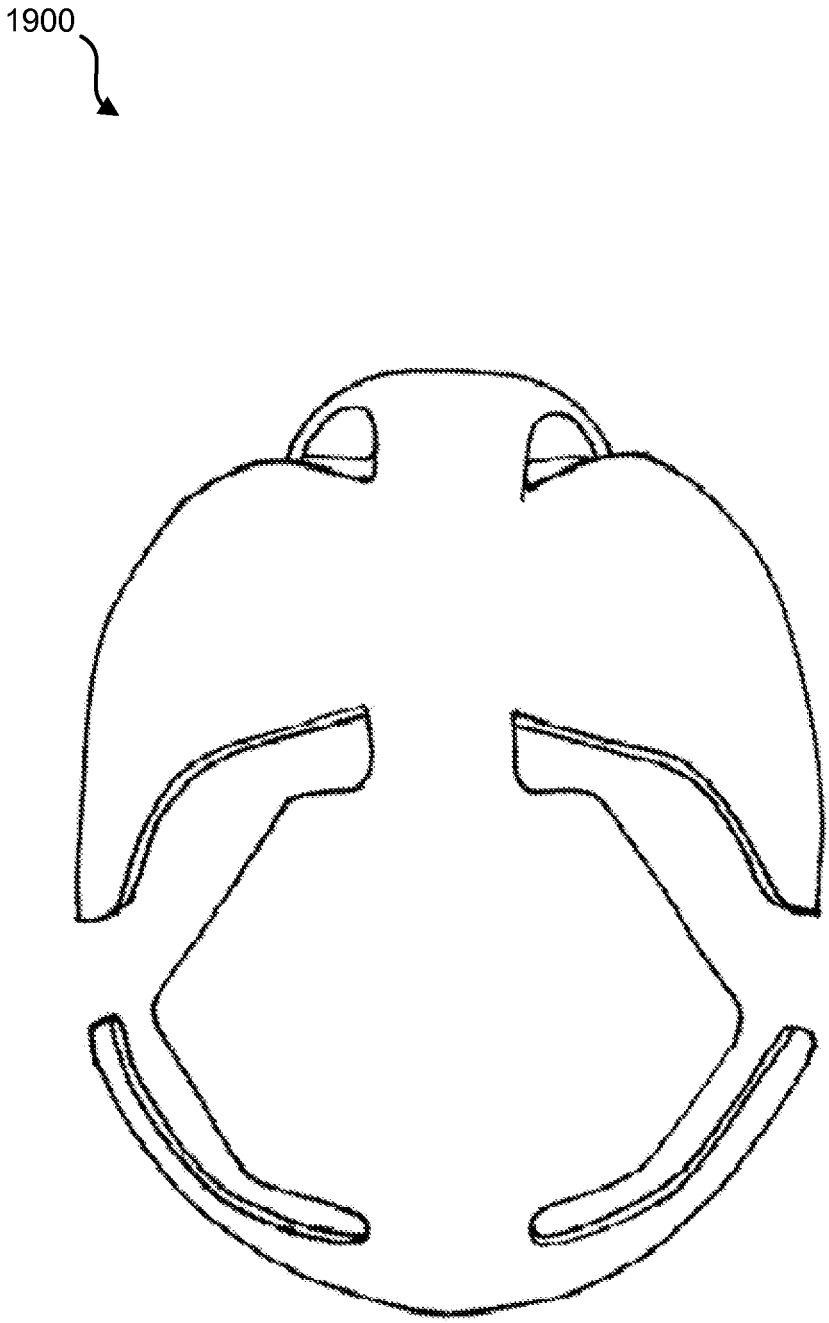
FIG. 19 illustrates another top view of an impact absorbing liner.

FIG. 17 illustrates a rear view of an impact absorbing liner 1700 as installed on the wearer's head. FIG. 18 illustrates a top view of an impact absorbing liner 1800 as installed on the wearer's head. FIG. 19 illustrates another top view of an impact absorbing liner 1900, in an assembled state.

Figure 20:
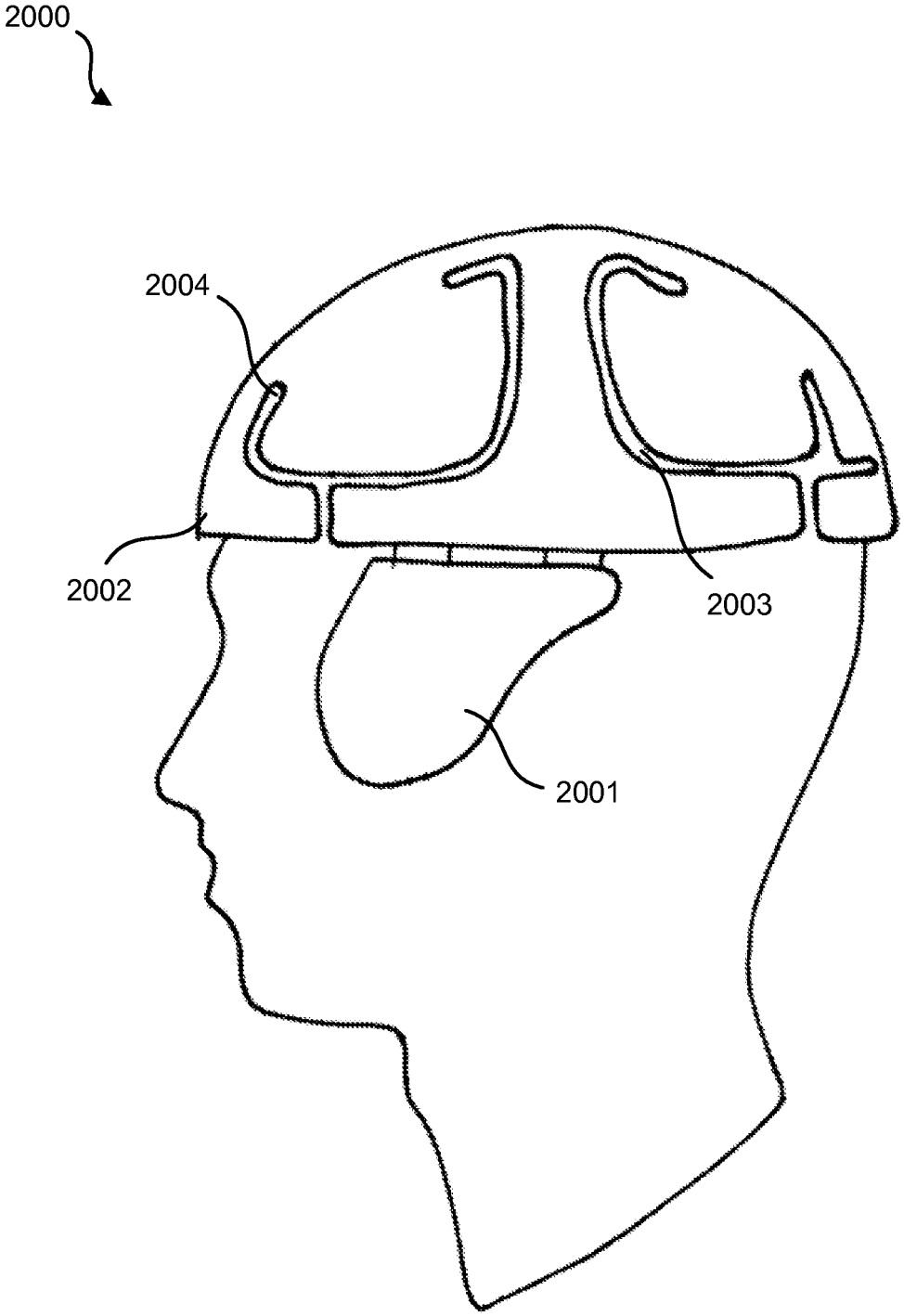
FIG. 20 illustrates arcs positioned on the outside profile for full coverage by an impact absorbing liner when installed, and also illustrates temple protection.

FIG. 20 illustrates a side view (left side shown) of a folded impact absorbing liner 2000 and 2002. Temple protection 2001 can be fitted on the left or right side (left side shown). Arcs 2003 and 2004 fold and conform to mating curvature for full coverage when installed.

Figure 21:
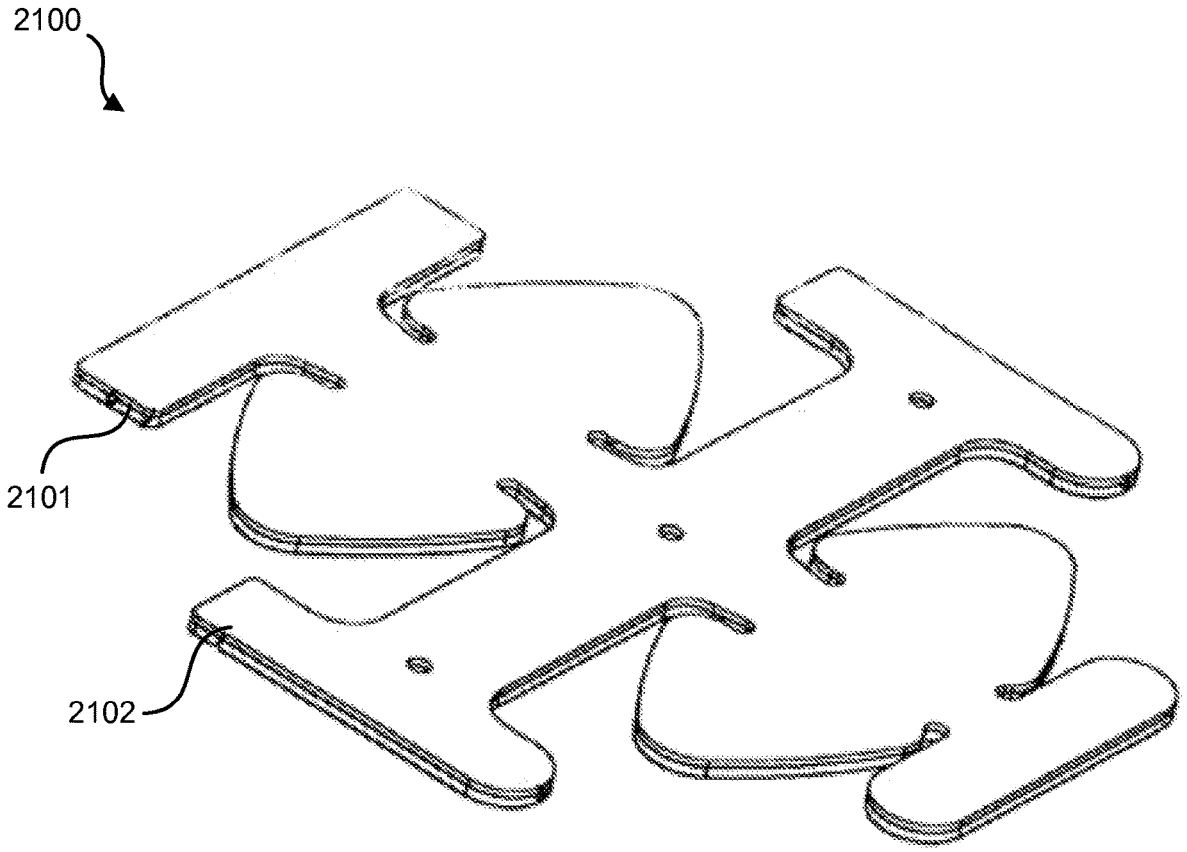
FIG. 21 illustrates integrated drawstring tubes.

FIG. 21 illustrates integrated drawstring tubes (dotted lines) 2100. An integrated drawstring tube is represented within an impact absorbing liner placed in the front band, 2101, and side bands, 2102, of the product.

Figure 22:
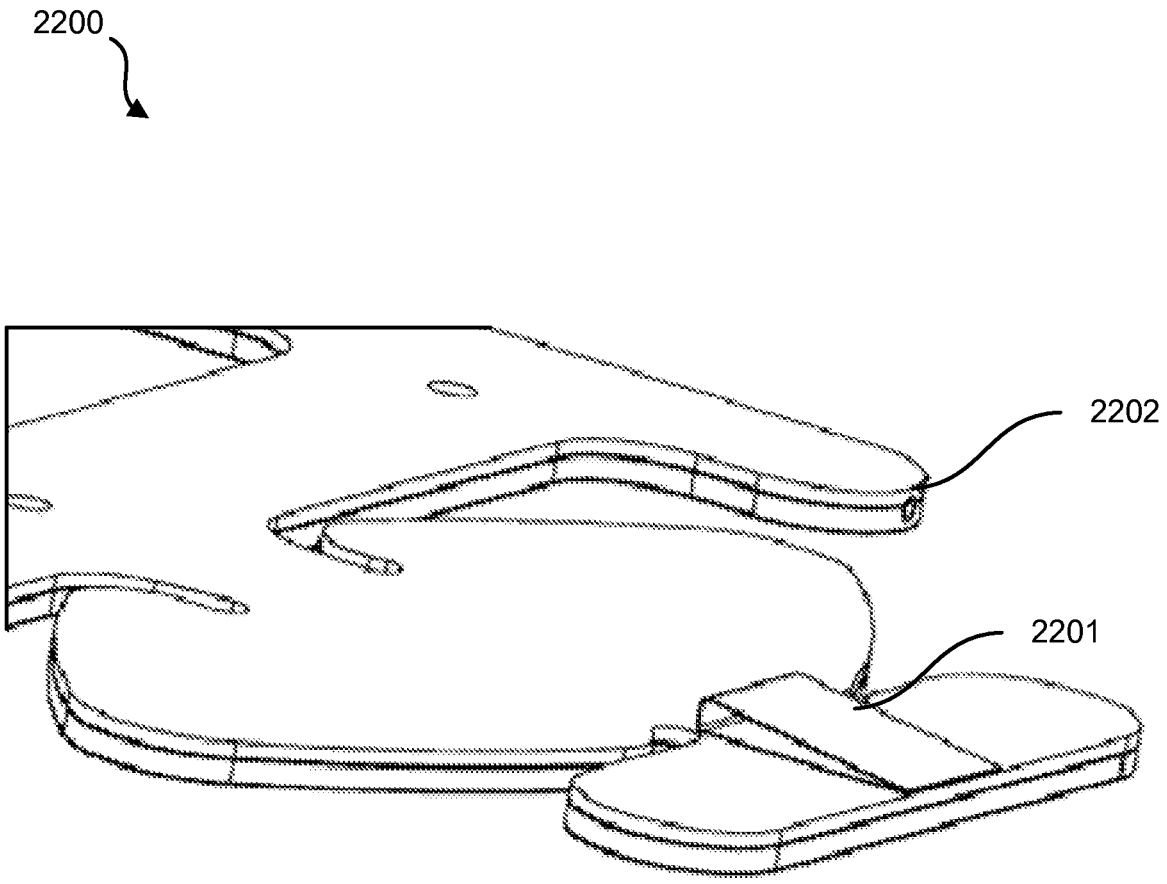
FIG. 22 illustrates an integrated clasp for snap-back and strap back hats.

FIG. 22 illustrates a close up isometric view of the back of an impact absorbing liner 2200. An integrated clasp 2201 for snap-back and strap back hats maintains proper alignment and secure attachment when installed into a hat. Drawstring tube in the side band 2202 is further described in FIG. 21.

Figure 23:
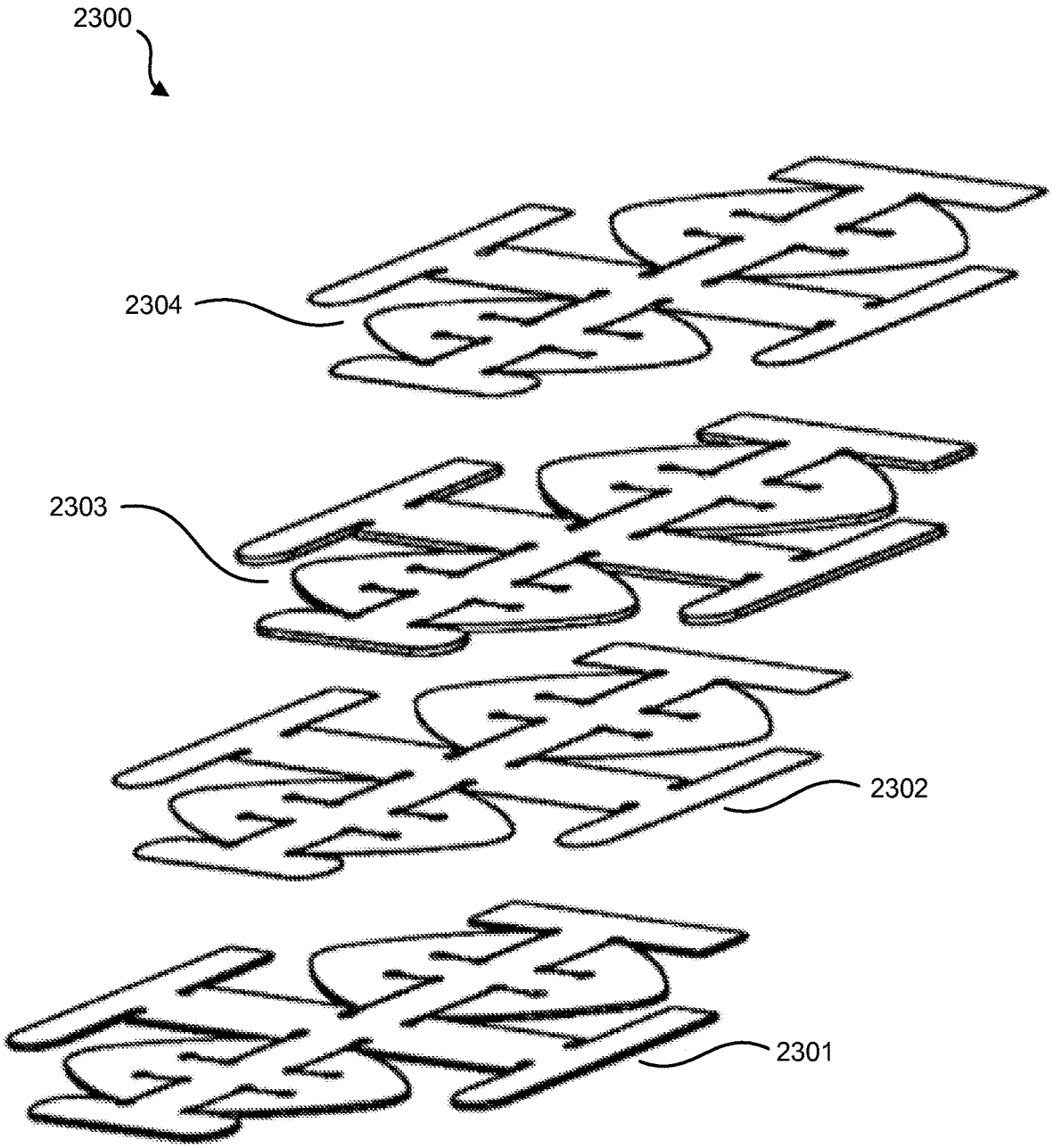
FIG. 23 is an exploded view of a layered configuration of an impact absorbing liner for headgear applications.

FIG. 23 is an exploded view of a layered configuration 2300 of an impact absorbing liner 2301 for headgear applications (additional layers can be applied). The impact absorbing liner 2301 includes a polymer layer 2302 to disperse impact loads and maintain structural integrity of the assembly. The polymer layer 2302 also resists puncture and tearing of the assembly. The impact absorbing liner 2301 further includes an inner impact absorbing layer 2303, and a breathable, moisture wicking fabric 2304.

Figure 24:
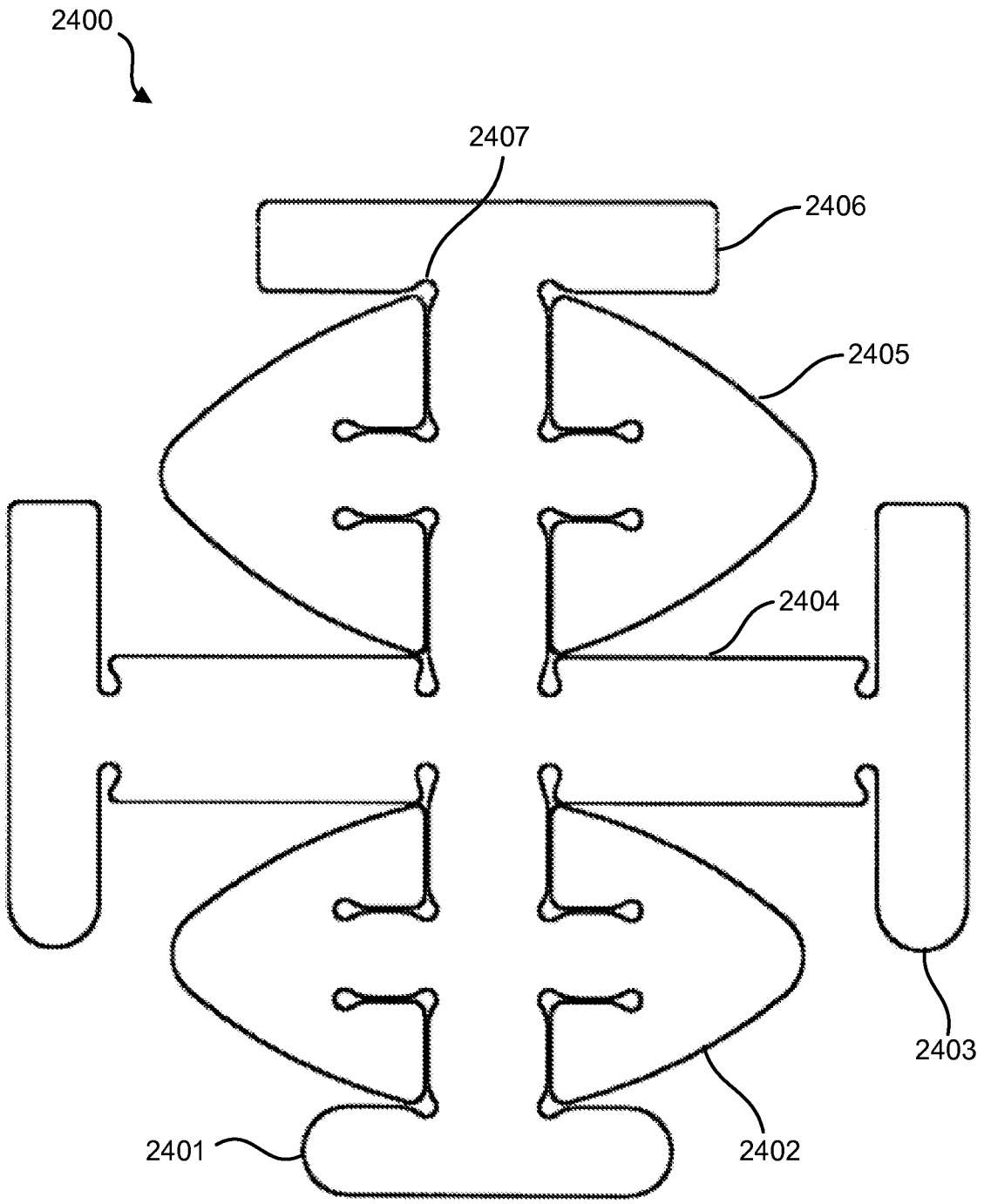
FIG. 24 is a two-dimensional profile showing an external shape and internal relief cuts.

FIG. 24 is a two-dimensional profile of an impact absorbing liner 2400 showing an external shape and internal relief cuts. The impact absorbing liner 2400 includes a back band 2401 that rests either inside of a sweatband of a hat, inside of a clasp on snap back hats or the like. The impact absorbing liner 2400 further includes a back ear member 2402 that provides extended coverage over the head with a tailored profile to offer a seamless transition between the back and side bands. Side band 2403 rests either inside of a sweatband of a hat or other method of securing in place. Side arm 2404 extends from the center portion of the product and connects the side band. Front ear member 2405 offers extended coverage over the head with a tailored profile to offer a seamless transition between the front and side bands. Front band 2406 rests either inside of a sweatband of a hat or other method of securing in place. This portion rests between the bill of a ball cap and the wearer's head. The front band offers coverage of the lower portion of the wearer's head and provides a mating edge for the front ear to provide maximum coverage. Undercut grooves 2407 to resist tearing and enhance movement when folded into a hemispherical shape as when worn on the head. The grooves shown are merely representative, and can be positioned throughout as needed to maximize folding effectiveness and coverage.

Figure 25:
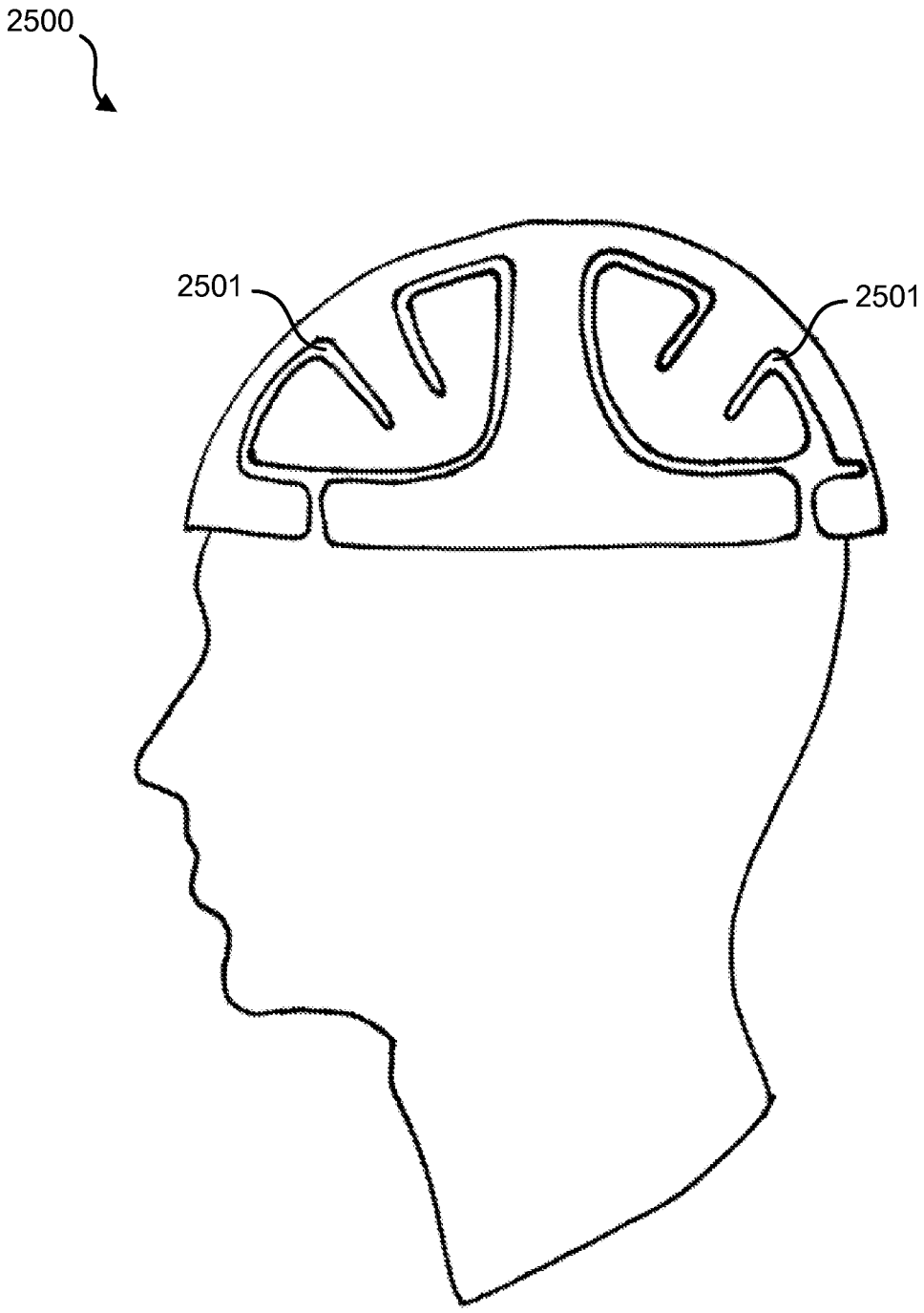
FIG. 25 illustrates a headgear application as installed on a representative head. Relief cuts placed at areas of curvature to enable conformity to the surface.

FIG. 25 illustrates a headgear application as installed on a representative head 2500. Relief cuts 2501 placed at areas of curvature to enable conformity to the surface. Remaining features as further described in FIG. 20.

Figure 26:
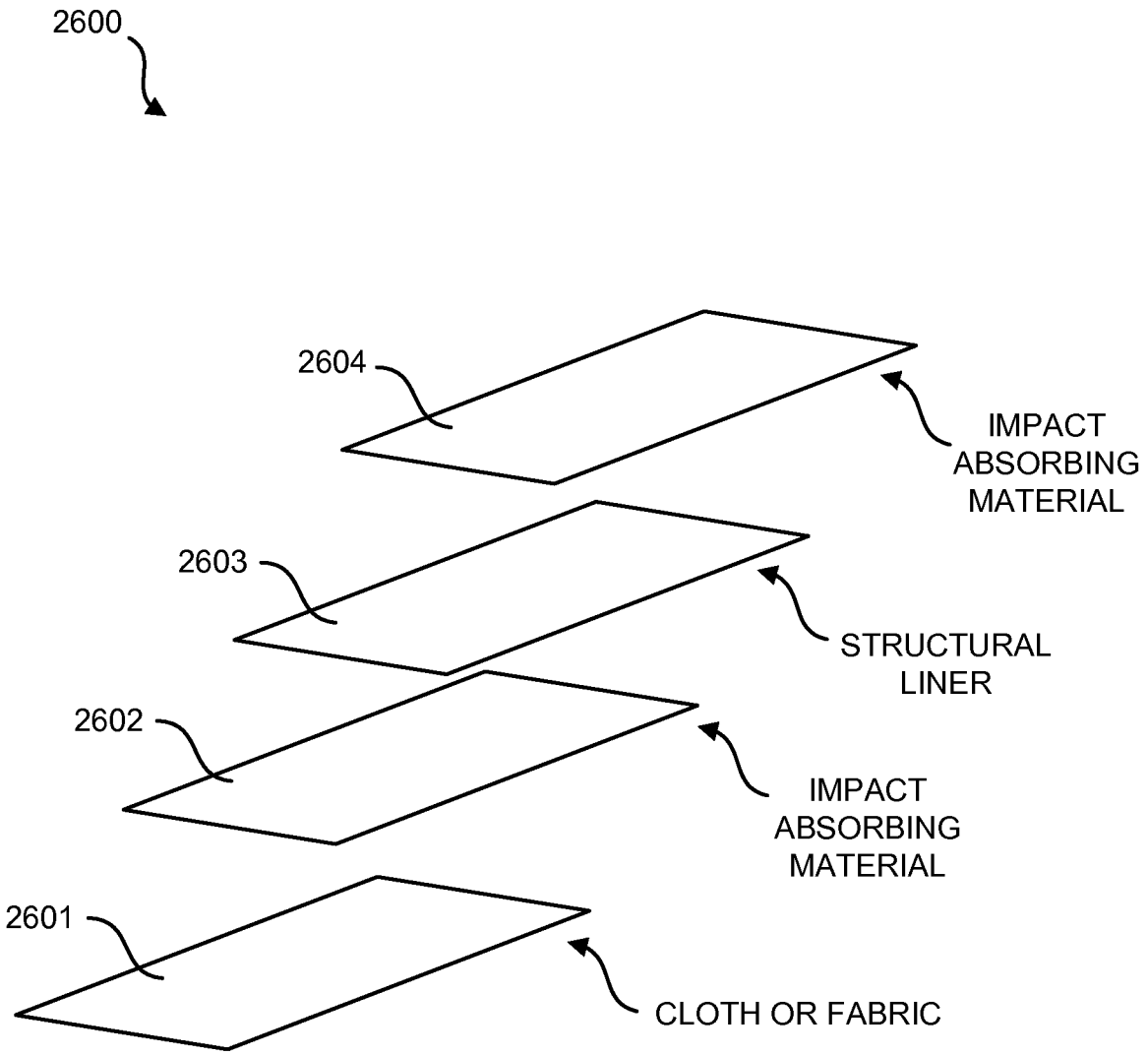
FIG. 26 is an exploded view of the base materials of an impact absorbing liner for lamination and prior to cutting parts.

FIG. 26 is an exploded view of the base materials of an impact absorbing liner 2600 for lamination and prior to cutting parts. The impact absorbing liner 2600 includes a cloth or performance fabric layer 2601, and an inner impact absorbing layer 2602. The impact absorbing liner 2600 further includes a polymer based semi rigid structural liner 2603. This liner provides lateral support and puncture resistance in addition to impact dispersion attributes. The impact absorbing liner 2600 further includes an outer impact absorbing layer 2604. Additional layers and combinations of polymer and impact absorbing materials can be applied as needed for a desired application.

Figure 27:
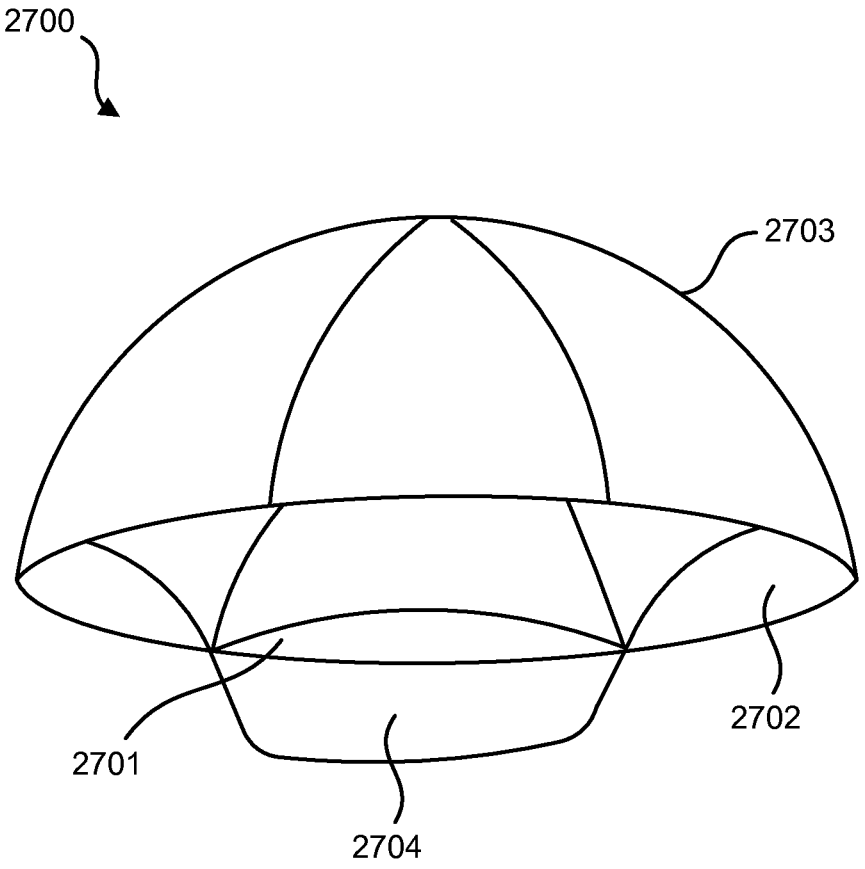
FIG. 27 is an isometric view of an outer encapsulation device to support an impact absorbing liner.

FIG. 27 is an isometric view of an outer encapsulation device 2700 to support an impact absorbing liner. The outer encapsulation device 2700 includes cover portions 2703. Additional impact absorbing layers can be inserted within integrated pockets 2701. Elastic band 2702 secures the impact absorbing liner to the encapsulation device with an elastic band to tighten the complete assembly to the wearer's head. Another elastic band 2704 is similar to elastic band 2702, however operates as a mechanism to fasten additional impact absorbing inserts.

Figure 28:
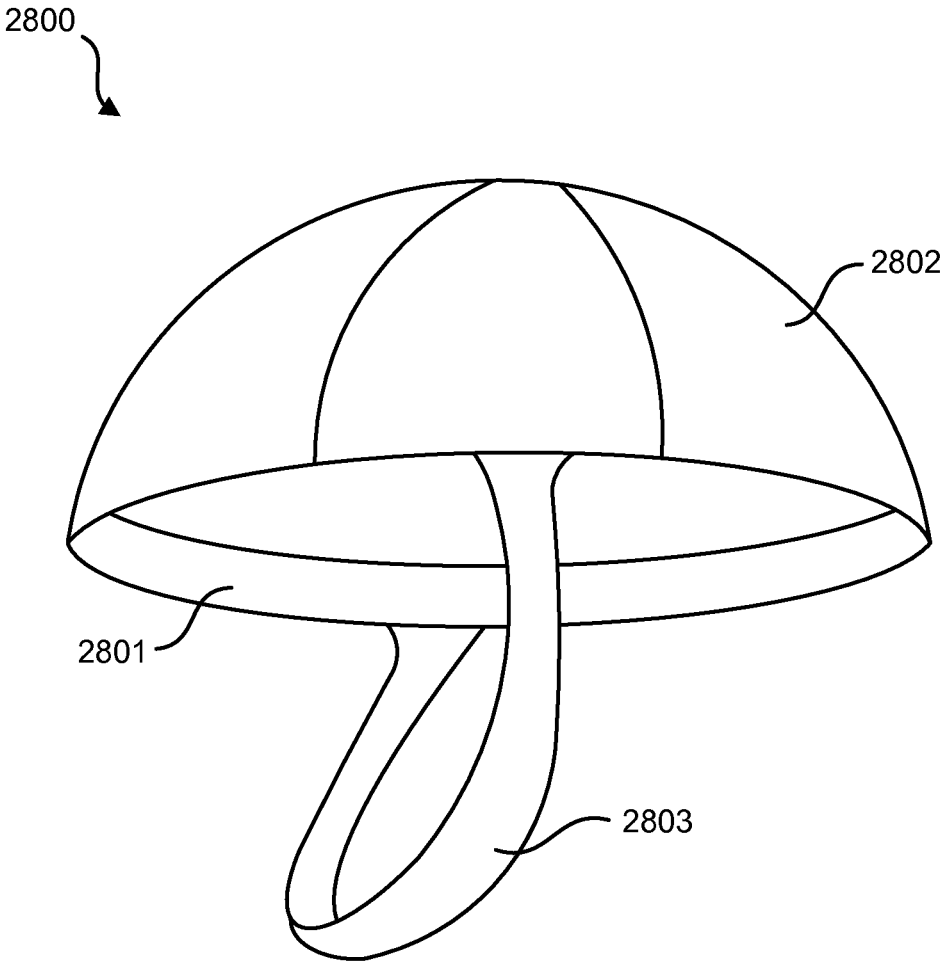
FIG. 28 is an isometric view of an outer encapsulation device to support an impact absorbing liner; and, FIG. 29 shows an impact absorbing insert.

FIG. 28 is an isometric view of an outer encapsulation device 2800 similar to FIG. 27. Encapsulation device 2802 incorporates an elastic band 2801 to secure to the head of the wearer. Pockets 2701 can be incorporated as discussed above. Chinstrap 2803 provides an additional method of fastening the assembly to the head of the wearer.

Figure 29:
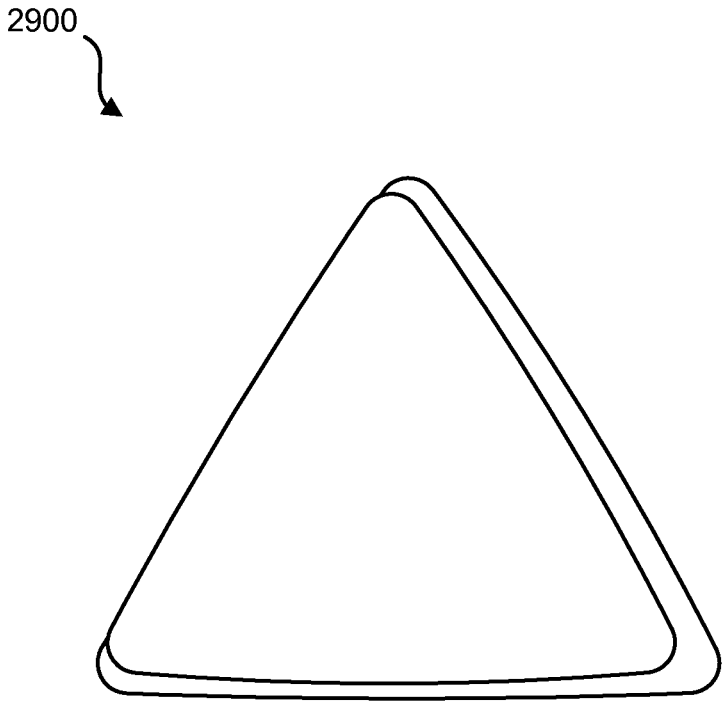

FIG. 29 shows an impact absorbing insert 2900 of similar composition as outlined in FIG. 26. Insert can be fitted into a secure pocket 2701 and held in place with an elastic band 2704.

The one or more layers of impact absorbing material can be encased in fabric, fused onto fabric or otherwise mated to a fabric liner to suit any particular application and aesthetic considerations. The fabric liner can be made from any fabric material, and can include antibacterial components to minimize the spreading of germs during heavy use. The fabric liner can also be washable, mold resistant, water resistant (either inherent from the base material or combined with a hydrophobic coating), and can include other components, such as metallic threading for radiation shielding, structural strength, and other features. The fabric can be breathable and offer moisture wicking qualities to support drying during and after use and when washed.

In some implementations, the impact absorbing liner is configured and formed of multiple density materials fused or otherwise connected together in a multi-ply configuration. This configuration provides additional application flexibility. For example, by having an outer layer (farthest from the body of a wearer) that is dense and rigid, an inner layer can be softer, less dense and less rigid, allowing for a more comfortable fit without sacrificing protection. Additionally, a rigid layer can be interposed between two or more non-rigid layers. Further still, the rigid layer can be implemented as a series of "bones" that form a "skeletal" structure, which is in turn surrounded or layered on top and/or the bottom by non-rigid layers. The rigid layer can fully cover the part with consistent thickness or have variable thicknesses and contours as needed for specific design requirements. The layer can be different from the other layers in size and shape or it can be identical to the non-rigid layers as needed for specific applications.

A thickness of the impact absorbing liner can also be varied or variable to suit a wide range of activities and applications. The thickness can also be varied within the same liner to provide custom protection without compromising weight. The profile can be adaptive and variable from one area to another area. For instance, thinner and lighter sections can be applied where impact is unlikely, while heavier profiles can be strategically positioned in high impact areas for maximum impact dispersion without adding overall weight. One example would be to protect high impact areas of the skull, such as the temples and where the spinal cord and skull meet.

As discussed above, the impact absorbing liner can be shaped to maximize head coverage for high-risk areas on a wearer's body. Accordingly, in some implementations, a profile of the impact absorbing liner has grooves and protrusions in strategic locations to focus in the protection where it is needed most to maximize impact dispersion while keeping areas with low impact risk as light-weight as possible. In still other implementations, an impact absorbing liner can be reversible to maximize versatility and adjust the impact resistance and/or comfort provided by the impact absorbing liner.

The impact absorbing liner can be permanently affixed to an item of apparel, such as integrated into fabric of the apparel, integrated into layers of the apparel, etc., provided with an exposed adhesive layer for user installation or can be removable though the use of mechanical fasteners, hook and loop straps (such as Velcro® or the like), zippers, snaps, clips, clamps, vice, or the like. In one example, an impact absorbing liner for headgear can be formed to use the headgear's existing sweatband as an anchor. Still, other containment mechanisms for the impact absorbing liner can be used. The impact absorbing liner can include one or more connector attachment points, which allow for easy adjustment using any of a variety of connection mechanisms, such as Velcro, snaps, buttons, serrated bands, etc. The impact absorbing liner is configured to be interchangeable, and therefore is highly versatile and easy to use among various applications. The impact absorbing liner can further include padding, which can be permanently or transiently affixed to an inside surface (i.e., a surface closest to a body of wearer), for more custom fitting, as well as added protection. The impact absorbing liner can be manufactured in various colors and textures to suit the branding and marketing demands.

An outer encapsulation device can be implemented to form the impact absorbing liner as described herein. Encapsulation device offers a means to utilize the impact absorbing liner without the need for a separate hat or headgear. Integrated pockets can be applied to provide a method of inserting additional impact absorbing layers as needed for a specific application. An elastic sweatband can be applied at the base of the device to secure the impact absorbing liner and provide an adjustable mechanism to attach to the head of the wearer and further secure the impact absorbing inserts. Encapsulation device can be fitted with a chinstrap that is either permanent or removable providing an additional method to secure the assembly to the head of a wearer.

Flex Grooves:

In some implementations, the impact absorbing liner includes one or more grooves, channels, indentations, or the like, ("grooves") placed or arranged in strategic locations on one or more surfaces, i.e. the inner surface, which allow for a smoother shaping and contouring to a body part of the wearer, and to provide flexibility or flexure to the impact absorbing liner for better conformance to various body shapes and sizes. The grooves also provide a unique profile for impact dispersion by allowing room for the material to flex, thereby absorbing additional force. The grooves further provide a path for air circulation to enhance breathability and reduce moisture during use.

Casing:

The impact absorbing liner can further include a casing, in accordance with alternative implementations. The casing can surround only the outer, inner or all around the impact absorbing liner to suit any particular application and/or aesthetic needs. Colors and patterns can be added and can include logos or other branding elements as needed. The casing can be made from puncture-proof, puncture-resistant, cut-proof, or cut-resistant materials, such as Kevlar thread, Teflon thread, carbon fiber threading, or the like. The casing can be interchangeable among one or more impact absorbing liner for sanitary or aesthetic needs.

One or more reinforcement frames can be applied or located where needed to provide specific protection for desired applications. This provides increased protection where it is needed for a specific activity to balance product weight, impact reduction, acceleration reduction and rigidity for the intended application.

Tightening System:

A tightening system such as a drawstring or cable can be applied for a low profile fastening mechanism that is easily adjustable to fit the user, and can be released for flat storage or transportation. Channel tubes can be integrated into the layers of the product or manufactured as part of the frame to provide seamless looping for the drawstring. Integral tubes eliminate the need for exposed or raised channels or grommets for the drawstring, and minimize stress concentrations on the users head, body or other specific application. Fastening and adjustment can be made using a knob lever or static friction groove.

The tightening system can be applied for circumferential adjustment and/or to control the height for a customized fit. A full coverage lattice arrangement can be applied to provide full coverage and maximum adjustability. Multiple fastening points can enable further adjustment and customization for the user.

The fastening device can also be operated by pinching a latched assembly. A serrated insert can slide freely when the latched assembly is pinched open, and lock when released. Allen wrenches or other tools can be used either in conjunction with the pinch-activated fastening device, or independently. The fastening device can also include a rotating knob to wind a tightening cord, and can be applied either to the liner or as part of the frame. The rotating knob includes a disk that is turned by hand and has a low profile. Allen wrenches or other tools can be used either in conjunction with the knob system, or independently.

Adjustment is provided in circumferential and/or vertical planes or directions, for universal fit for all head shapes and sizes. Accordingly, the impact absorbing liner can be easily adapted to varying sizes of body parts, such as varied head roundness, width, length or other dimension. The flexibility of the material can provide further for fine adjustment and a snug, secure fit.

Alignment Holes:

Holes can be placed in strategic locations for aiding assembly by providing alignment guides. In some implementations, the alignment holes can be unique or universal to utilize the existing aeration holes (as previously described). A size of the holes can be customized to adapt to existing manufacturing jigs, and the holes can be located for additional attachment points. The alignment holes can also be strategically located throughout the part to allow stress relieve over a contoured area of the body or equipment being protected. This can minimize bunching and increase the overall surface area coverage on complex and contoured areas.

Folding Parts:

By folding each component within the part, the total number of parts within the assembly are reduced. Creases and outside profiles are configured to enable flat packaging and folding for storage when product is not in use. This profile can conform to the inside of the user's headgear, outside of the head or other configurations as needed for the application.

The shape and profile of the impact absorbing liner provides maximum coverage when worn or applied on the users body (via headgear or apparel) while allowing for a universal fit that is adjustable for adult and youth sizes. The versatile design ensures full coverage for strategic locations. Thickness and density of protective layers are provided and can be varied in specific locations to support performance objectives for intended applications.

In some implementations, the profile, material thickness and densities employed in the impact absorbing liner are adaptable to fit within the sweatband of existing or custom headgear as to not require a larger or replacement hat, garment or other covering to properly use. Arcs on the "wing" sections of the part provide increased surface coverage when folded into the headgear or garment and in general for highly contoured surfaces.

Strategic cuts can be placed in the part to encourage conformity when applied to curved surfaces. In one example, the headgear liner has cuts on the wing sections to conform the users head shape. This conformity can provide additional and complete coverage compared to not having relief cuts. Relief cuts placed at areas of curvature to enable conformity to the mating surface.

Adhesive Layers:

One or more wet or tacky adhesive layers can be applied to attach several layers of varied thicknesses and densities. In some implementations, a dry adhesive can be heat sensitive which can allow for easier final alignment before "setting" in position. An adhesive can be installed via sheet/spray/film/etc. is applied before or after profile cutting.

Adhesion for each layer can occur before part cutting to simplify assembly. Where required, adhesive is applied after part cut out or before cut out. If assembly of the parts is required after cut out, a release liner is applied to the adhesive layer to allow for proper alignment and storage prior to final assembly.

Snap-Back Clasp:

A clasp can be integral or provided separately to fasten the liner to the existing clasp on snap-back hats. The clasp on the product can be low profile as to be universal for multiple hat applications and not limited to snap-back hats. The clasp maintains alignment and provides a mechanism to fasten the liner within the headgear or hat.

The clasp can be mechanically attached to the liner using adhesive, rivets, clamps, sewing, hook and loop attachments (i.e. Velcro), or the like. Additionally, the clasp can be permanently vulcanized to the foam or inner frame.

Temple and Spinal Guard:

The impact absorbing liner can be positioned below the hat line to offer additional coverage over the temple. Applications include, but not limited to, baseball base coaches, sporting coaches, baseball pitchers, baseball catchers, golf or any activity where a projectile could contact a user's temple. A temple guard can be applied on either the left or right side, and can be formed of the multiple layer technology described herein. One or more additional outer shells can be applied to provide additional protection. If an outside shell is used, it can provide a foundation to contour the guard to match the users head profile for a custom or form fitted part. An area of the user's body where the skull and spinal cord meet can have a multi layered protective protrusion to protect against a direct impact to the back of the head.

Layered Material:

In some implementations, an article of manufacture includes a layer of impact absorbing material followed by a rigid or semi-rigid layer, followed again by another layer of impact absorbing material. Additional layers of similar composition can be added and affixed to the assembly as needed to achieve the desired thickness and impact reduction performance.

The impact absorbing material can be made of "smart molecules" that harden on impact, open cell urethane foam rubber, closed cell urethane foam rubber, silicone elastomer, polycarbonate, Kevlar, textiles or the like, and formed to fit the unique profile needed for a specific application.

The material can be provided in sheets of varying length and width dimensions, rolls of varying widths, patterns or the like as needed for a specific application. Material can be manufactured with or without fabric, with or without adhesive exposed for attaching to substrate, equipment or coverings or the like.

Each layers thickness can be custom tailored for specific applications. The Impact reduction material thickness can range from 0.5 mm to 15 mm and density can range from 5 lb/ft^3 to 50 lb/ft^3. The denser layer can be placed on the side of the impact but can also be aligned on the inside liner which contacts the protected surface. The less dense layer can be placed on the side of the protected surface but can also be arranged on the side of impact. Multiple layers of impact reduction mater and rigid substrate can be applied in various sequences to suit the specific application. A dense layer of impact reduction material can be placed directly onto a less dense layer of impact reduction material creating a unique performance characteristic. Rigid liner substrate can be applied in multiple locations as needed for the application.

Individual Insert:

In some implementations, an article of manufacture includes a contoured hard outer shell and layered impact absorbent liner inside. The impact absorbent liner can have an integrated intermediate frame, formed of different materials or densities, the same material or densities, or any combination thereof. A contoured shell can be flexible or pre-formed to match the contour of the mating surface. In one exemplary application for headgear, the hard shell can be shaped to fit the inside of a hat or the contour of the head. A shape of the impact absorbing liner can vary to suit a desired application. Each application can consist of several individual shapes of the same or different dimensions as needed to suit the application.

The individual inserts can be attached to an existing garment or structure as to not be visible from the outside. Individual inserts can be applied independently or in a sequence as to provide partial or full coverage as needed for the application. An attachment mechanism can be permanent or removable as needed for the application. Attachment mechanisms can include, but not limited to, wet adhesive, dry adhesive, rivet, snap, button, zipper, hook and loop fastener, interlaced string, sewn, vulcanization, or the like.

Miscellaneous:

The impact absorbing liner can include a loop applied to the side, front or rear edge of the assembly to allow for attachment to a belt or bag when not in use. The loop can be attached using a mating hook, loop or carabiner. The loop can be integral to the internal structure or attached to the final assembly using adhesives, button, snap, clamp or sewn in.

Automatic adjustment can be achieved using a slide-lock, rotational-lock, or other interval locking device. The interval locking device is designed so that adjustment is easily achieved while in use but does not have adverse protective or aesthetic affects from protrusions, which can cause a point load and risk injuring the user on impact. Adjustment can also be achieved using a removable tool.

A gripping material can be applied to either the inside or outside of the impact absorbing liner as needed to ensure a secure fit on the user's head or piece of equipment during extreme use. The gripping material can be integral with the liner manufacturing or added on as a post manufacturing feature. The gripping material can be a firm elastomer which is formulated to provide maximum adherence especially during active, cold, hot, wet, dry, dusty and other environments.

The impact absorbing liner can also include one or more of reflectors, lights and glow-in-the-dark or other luminescent materials ("light features"), which can be applied for customizations and for safety during low light use conditions. The light features can be arranged to enhance branding, logos, or otherwise custom graphics as needed or desired, and/or applied in zone-based locations to enhance visibility during a particular sport or activity.

The impact absorbing liner can further include one or more accessory mounts for electronic devices, phones, cameras, computers, data collection devices, storage devices, sensors, Global Positioning System (GPS), headphone attachments, speakers, or the like.

Electronic Adaptations:

The impact absorbing liner can include a radio frequency (RF) protection liner that can be applied as a coating or physical liner. The RF protection liner can be integral with the impact absorbing liner, provided as a casing or as a separate add-on product. RF protection liner can be affixed using the structural frame for a secure fit.

In some implementations, the impact absorbing liner can include one or more sensors can be connected with or integral with any part of the impact absorbing liner, to measure and record G-forces, forces of impact, speed, elevation changes, geo-positioning or location data, impact data, biometric data such as heart rate, body temperature, breathing rate, calorie consumption, calories burned, or the like. The sensors can be configured to communicate wirelessly or via wired connection to a smartphone or computer device for monitoring by medical staff or spectators while worn by the user. A data connector, such as a universal serial bus (USB) connector, can be adapted to download recorded data.

Lighting can be integrated into the liner by layering within the material during manufacturing, incorporating into the internal frame or the like. Lighting can be light emitting diode (LED), liquid crystal display (LCD), or any other light emitting mechanism. The lighting can be powered by external batteries, rechargeable power source, solar panels or the like. The lighting can be placed in any direction as needed for the application. Placement can be, but not limited to, head lamp, side indicators, back indicators or the like. Applications include but not limited to hiking, biking, walking, running, jogging, sports, hobby projects, camping, baseball, football, hockey, skateboarding, reading, or the like.

A wireless communication connectivity such as Bluetooth or other can be provided for head phone or cell phone connectivity, and for controls for media devices for hands free convenience. Wireless communication can also be used to communicate biometric data from the impact resistant liner to a mobile device or storage device.

A self-correcting mechanisms can be integrated to enable automatic resizing and automatic placement for ease of use and interchangeability. Solar panels can be applied to power integrated sensors or for external devices such as phones, watches and computers. Headphones, hearing aids and microphones can also be integrated as an add-on or integrated into the apparel design for specified user communities and applications.

Although a few embodiments have been described in detail above, other modifications are possible. Other embodiments may be within the scope of the following claims.

The invention claimed is:

1. A detachable impact absorbing liner for a hat, the detachable impact absorbing liner comprising:

an internal frame formed of polycarbonate, the internal frame having a trunk member extending from a frontal portion to a rear portion, and a plurality of branch members extending laterally from the trunk member, the plurality of branch members comprising a pair of frontal branch members, a pair of rear branch members, and at least two additional branch members that extend from opposite sides of the trunk member having side members extending laterally from a distal end of each of the at least two additional branch members, the internal frame further including a clasping system comprising a clasping mechanism on a distal end of each of the side members and on a distal end of each adjacent branch member of the plurality of branch members, the clasping system enabling the internal frame to be shaped and fastened in a semi-spherical shape to conform to a shape of a wearer's head and to be positioned within the hat;

two or more impact resistant layers coupled with the internal frame, the two or more impact resistant layers comprising a polymer layer coupled with a first side of the internal frame and having a first density to resist puncture and tearing, and an inner impact absorbing layer coupled to the polymer layer and having a second density to resist impact, and a breathable, moisture-wicking fabric attached to the inner impact absorbing layer opposite the polymer layer, wherein the internal frame is interposed between the polymer layer and the inner impact absorbing layer, the two or more impact resistant layers covering a majority of the internal frame and being formed with cut-ins to allow the two or more impact resistant layers to conform to the shape of the wearer's head when the internal frame is shaped and fastened in the semi-spherical shape.

2. The detachable impact absorbing liner in accordance with claim 1, wherein the two or more impact resistant layers include a plurality of aeration holes.

3. The detachable impact absorbing liner in accordance with claim 1, wherein the inner frame includes a set of channels formed in the trunk member or in one or more of the plurality of branch members.

4. The detachable impact absorbing liner in accordance with claim 1, further comprising an attachment mechanism for attaching the impact absorbing liner to an internal cavity of the hat.

5. The detachable impact absorbing liner in accordance with claim 1, further comprising an additional internal frame.

6. The detachable impact absorbing liner in accordance with claim 1, further comprising a chin strap configured to secure the detachable impact absorbing liner to the wearer's head.

7. The detachable impact absorbing liner in accordance with claim 1, further comprising an outer encapsulation device having cover portions attached to the two or more impact resistant layers and internal frame with one or more elastic bands.

* * * * *